US010926539B2

(12) United States Patent
Mizuno

(10) Patent No.: US 10,926,539 B2
(45) Date of Patent: Feb. 23, 2021

(54) LIQUID DISCHARGE APPARATUS AND LIQUID DISCHARGE HEAD

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/453,350

(22) Filed: Jun. 26, 2019

(65) Prior Publication Data

US 2020/0101729 A1 Apr. 2, 2020

(30) Foreign Application Priority Data

Sep. 27, 2018 (JP) ..... JP2018-181225

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ..... B41J 2202/20; B41J 2/1433
See application file for complete search history.

(56) References Cited

U.S. PATENT DOCUMENTS

| | | | | |
|---|---|---|---|---|
| 2008/0060198 | A1* | 3/2008 | Nakashima ..... | B41J 2/14209 29/890.1 |
| 2012/0176450 | A1 | 7/2012 | Akahane et al. | |
| 2017/0217176 | A1 | 8/2017 | Sato et al. | |
| 2017/0217197 | A1 | 8/2017 | Kanegai et al. | |
| 2017/0217199 | A1 | 8/2017 | Yamagishi et al. | |
| 2017/0305155 | A1 | 10/2017 | Kanegai | |

FOREIGN PATENT DOCUMENTS

| | | | |
|---|---|---|---|
| JP | 2007-90694 | A | 4/2007 |
| JP | 3925406 | A | 6/2007 |
| JP | 4940611 | B2 | 5/2012 |
| JP | 5962935 | B2 | 8/2016 |
| JP | 2017-136720 | A | 8/2017 |
| JP | 2017-193132 | A | 10/2017 |
| JP | 2017-202677 | A | 11/2017 |

* cited by examiner

*Primary Examiner* — Jason S Uhlenhake
(74) *Attorney, Agent, or Firm* — Merchant & Gould, P.C.

(57) ABSTRACT

There is provided a liquid discharge apparatus including: at least one liquid discharge head; and a holding member holding the liquid discharge head. The liquid discharge head includes: a nozzle plate; a first channel member stacked on the nozzle plate in a first direction and including a channel through which liquid is supplied to the nozzles, and a second channel member including at least one plate and arranged between the nozzle plate and the first channel member in the first direction, the second channel member including individual channels connected to the nozzles. The second channel member includes a securing portion secured to the holding member and provided at a position closer to the nozzle plate than the first channel member.

28 Claims, 10 Drawing Sheets

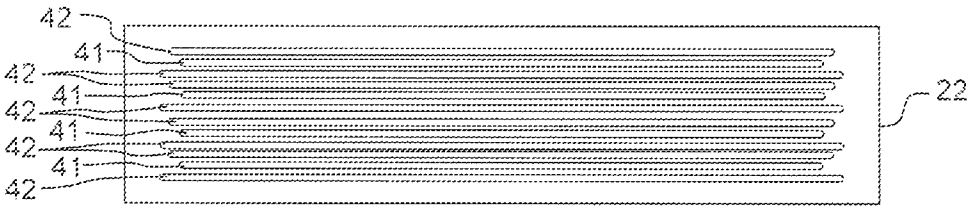
Fig. 4A
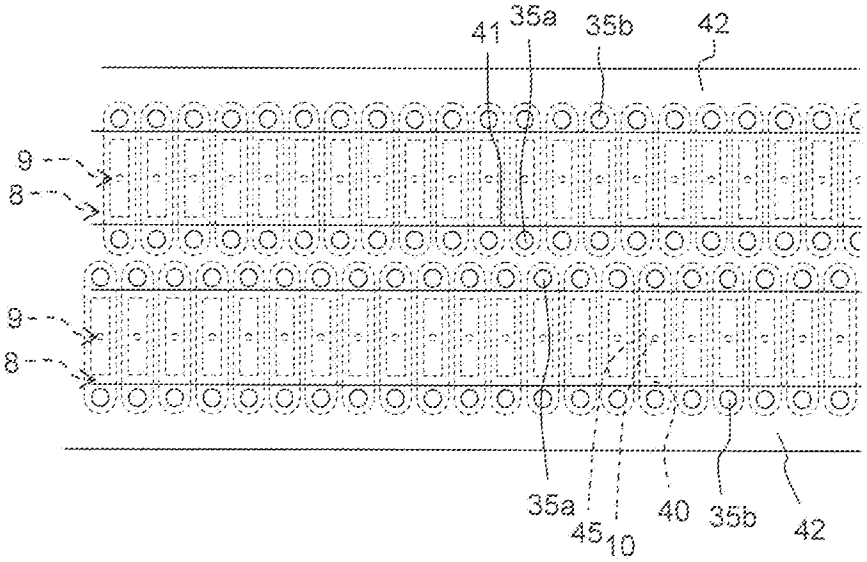
Fig. 4B
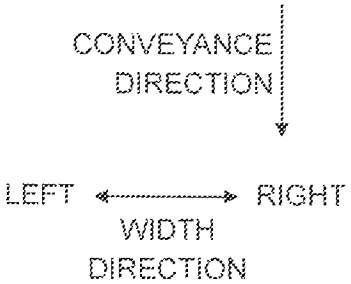

LIQUID DISCHARGE APPARATUS AND LIQUID DISCHARGE HEAD

CROSS REFERENCE TO RELATED APPLICATION

The present application claims priority from Japanese Patent Application No. 2018-181225 filed on Sep. 27, 2018, the disclosure of which is incorporated herein by reference in its entirety.

BACKGROUND

Field of the Invention

The present disclosure relates to a liquid discharge apparatus configured to discharge liquid from nozzles and a liquid discharge head included in the liquid discharge apparatus.

Description of the Related Art

There is conventionally known, as an exemplary liquid discharge apparatus configured to discharge liquid from nozzles, an ink-jet printer configured to discharge ink from nozzles to perform printing on a medium. For example, an ink-jet printer of which head is secured to a support substrate is publicly known. A manifold is disposed above a holding plate that holds a head chip including the nozzles, and a casing frame including a frame ink channel coupled to an ink supply tube is disposed above the manifold. The casing frame is provided with a plate-like securing portion that is parallel to a surface on which the head of the support substrate is provided, and the head is secured to the support substrate through the securing portion.

SUMMARY

In the above ink-jet printer, the securing portion for securing the head to the support substrate is provided in the casing frame that is poisoned away from the head chip including the nozzles. In that configuration, a positional shift of nozzles associated with a positional shift caused when the head is secured to the support substrate through the securing portion is large.

An object of the present disclosure is to provide a liquid discharge apparatus that is capable of making a positional shift of nozzles caused when a liquid discharge head is secured to a holding member as small as possible, and the liquid discharge head included in the liquid discharge apparatus.

According to a first aspect of the present disclosure, there is provided a liquid discharge apparatus, including: at least one liquid discharge head; and a holding member holding the liquid discharge head. The at least one liquid discharge head includes: a nozzle plate in which a plurality of nozzles are open; a first channel member stacked on the nozzle plate in a first direction and including a channel through which liquid is supplied to the nozzles, and a second channel member including at least one plate and arranged between the nozzle plate and the first channel member in the first direction, the second channel member including a plurality of individual channels connected to the nozzles. The second channel member includes a securing portion secured to the holding member and provided at a position closer to the nozzle plate than the first channel member.

According to a second aspect of the present disclosure, there is provided a liquid discharge head, including: a nozzle plate in which a plurality of nozzles is open; a first channel member stacked on the nozzle plate in a first direction and including a channel through which liquid is supplied to the nozzles, and a second channel member including at least one plate and arranged between the nozzle plate and the first channel member in the first direction, the second channel member including a plurality of individual channels. The second channel member includes a securing portion secured to the holding member and provided at a position closer to the nozzle plate than the first channel member.

In the above configuration, the securing portion secured to the holding member of the liquid discharge head is provided at the position included in the second channel member including the individual channels and closer to the nozzle plate than the first channel member. It is thus possible to reduce variation in positions of nozzles as much as possible which may otherwise be caused when the liquid discharge head is secured to the holding member.

BRIEF DESCRIPTION OF THE DRAWINGS

FIG. 4A is a plan view of a lower-side manifold plate, and FIG. 4B is an enlarged view of part of the lower-side manifold plate depicted in FIG. 4A where channels in an individual unit are also depicted.

DESCRIPTION OF THE EMBODIMENTS

An embodiment of the present disclosure is explained below.

<Configuration of Printer>

Figure 1:
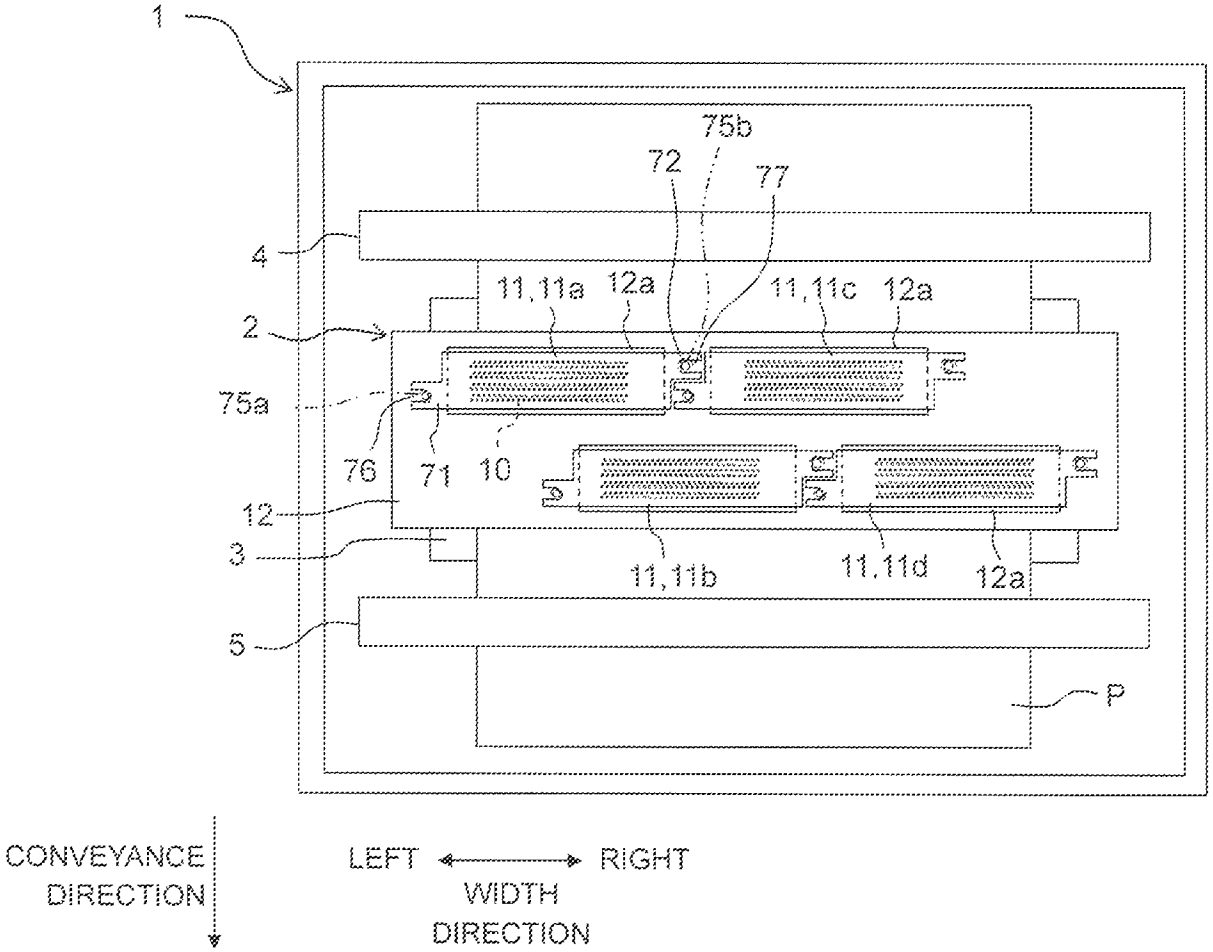
FIG. 1 schematically depicts a configuration of a printer according to an embodiment of the present disclosure.

As depicted in FIG. 1, a printer 1 according to this embodiment (a liquid discharge apparatus of the present disclosure) includes an ink-jet head 2, a platen 3, conveyance rollers 4 and 5, and the like.

Figure 2:
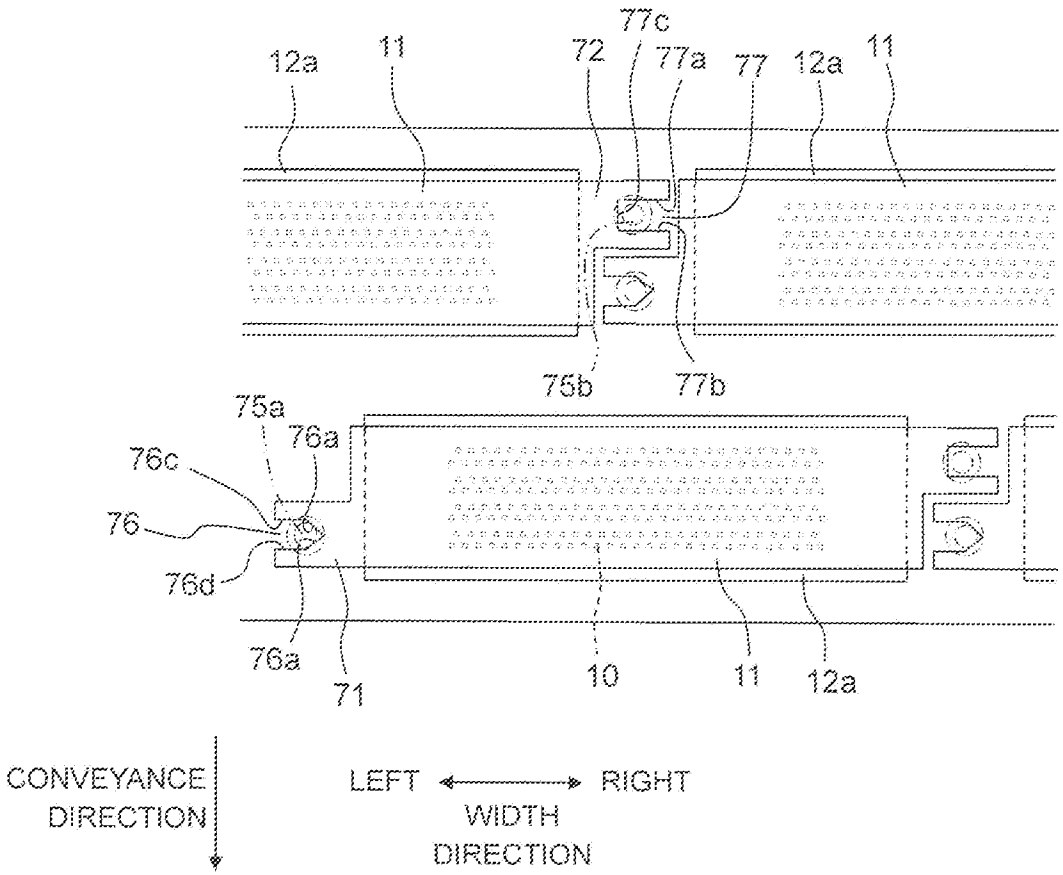
FIG. 2 is an enlarged view of parts of head units depicted in FIG. 1.
Figure 3:
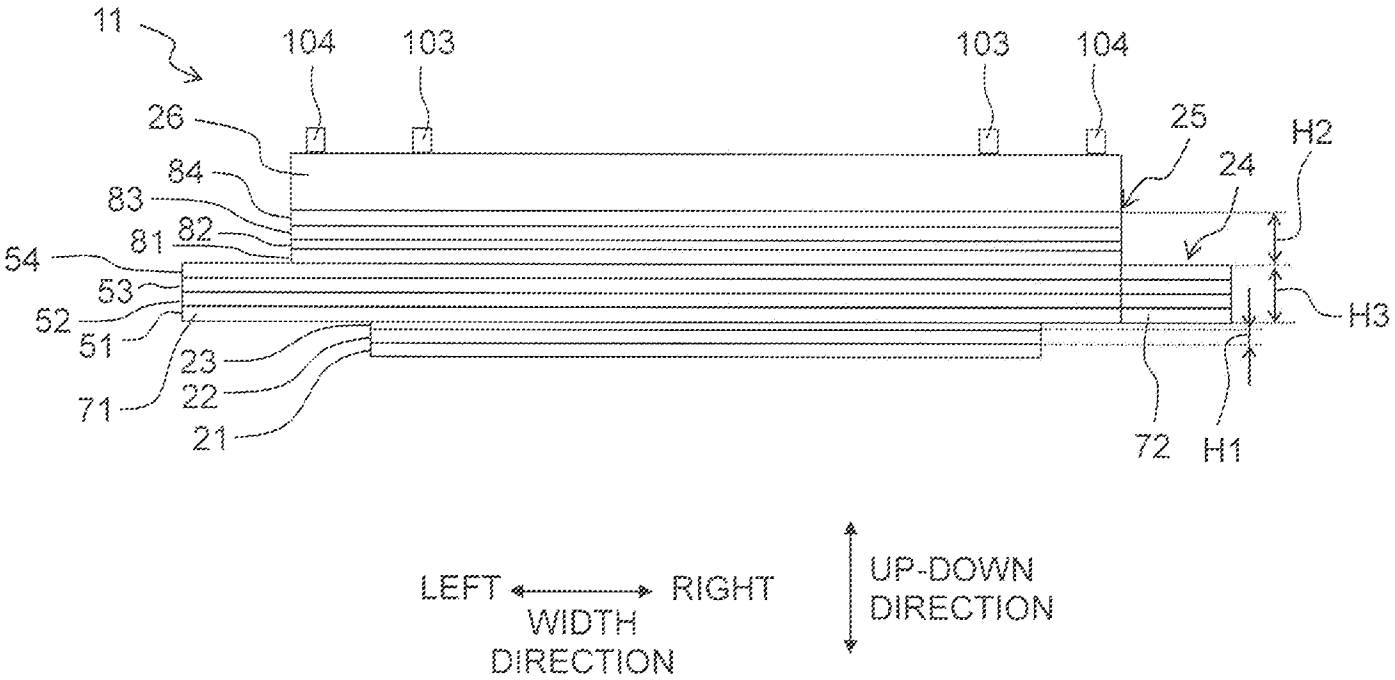
FIG. 3 depicts the head unit when seen from a downstream side in a conveyance direction.

As depicted in FIGS. 1 and 2, the ink-jet head 2 includes four head units 11*a* to 11*d* and a holding member 12. When the four head units are not distinguished from each other, each head unit may be referred to as a head unit 11. The head unit 11 (a liquid discharge head of the present disclosure) discharges ink from nozzles 10, which are formed in a lower surface of the head unit 11. More specifically, the nozzles 10 are aligned in a width direction (a second direction of the present disclosure) to form each nozzle row 9. The head unit 11 includes eight nozzle rows 9 arranged in a conveyance direction (a third direction of the present disclosure) orthogonal to the width direction. The width direction and the conveyance direction in this embodiment are defined as indicated in FIG. 1. Further, an up-down direction in this embodiment (a first direction of the present disclosure) is defined as indicated in FIG. 3.

Of the eight nozzle rows 9, nozzles 10 forming odd-numbered nozzle rows 9 from an upstream side in the conveyance direction are shifted in the width direction from nozzles 10 forming even-numbered nozzle rows 9 by a length that is half of a spaced interval in the width direction between nozzles 10 of each nozzle row 9. A black ink is discharged from nozzles 10 forming the first and second nozzle rows 9 from the upstream side in the conveyance direction. Similarly, a yellow ink is discharged from nozzles 10 forming the third and fourth nozzle rows 9 from the upstream side in the conveyance direction, a cyan ink is discharged from nozzles 10 forming the fifth and sixth nozzle rows 9 from the upstream side in the conveyance direction, and a magenta ink is discharged from nozzles 10 forming the seventh and eighth nozzle rows 9 from the upstream side in the conveyance direction. The following explanation is made by defining right and left sides in the width direction as indicated in FIG. 1. Further, in the following explanation, the i-th element from the upstream side in the conveyance direction is simply referred to as the i-th element.

The head unit 11*a* and the head unit 11*c* are arranged side by side in the width direction, and the head unit 11*b* and the head unit 11*d* are arranged side by side in the width direction. The head units 11*b* and 11*d* are positioned downstream of the head units 11*a* and 11*c* in the conveyance direction orthogonal to the width direction. The head units 11*b* and 11*d* are arranged to shift rightward in the width direction from the head units 11*a* and 11*c*. Thus, in the ink-jet head 2, the nozzles 10 of the four head units 11 are aligned to extend over an entire length in the width direction of a recording sheet P. Namely, the ink-jet head 2 is a line head. Detailed configurations of the head unit 11 are described below.

The holding member 12 is a plate-like rectangular member that is long in the width direction. The four head units 11 are secured to the holding member 12. The configuration for securing the head units 11 to the holding member 12 is described below. The holding member 12 has four rectangular through holes 12*a* that respectively correspond to the four head units 11. The nozzles 10 of the head units 11 are exposed to a lower side (recording sheet P side) through the respective through holes 12*a*.

The platen 3, which is disposed below the ink-jet head 2, faces the nozzles 10 of the four head units 11. The platen 3 supports the recording sheet P from below. The conveyance roller 4 is disposed upstream of the ink-jet head 2 and the platen 3 in the conveyance direction. The conveyance roller 5 is disposed downstream of the ink-jet head 2 and the platen 3 in the conveyance direction. The conveyance rollers 4 and 5 convey the recording sheet P in the conveyance direction.

The printer 1 performs recording on the recording sheet P by conveying the recording sheet P in the conveyance direction by use of the conveyance rollers 4 and 5 and discharging ink(s) from the nozzles 10 of the four head units 11.

<Head Unit>

Subsequently, the head units 11 are explained. As depicted in FIGS. 2 to 9, each head unit 11 includes an individual unit 21, a lower-side manifold plate 22 (a first common channel member of the present disclosure), a damper film 23, a connection channel unit 24 (a connection channel member of the present disclosure), an upper-side manifold unit 25 (a second supply channel member of the present disclosure), and a tube connection member 26 (a first channel member of the present disclosure). In this embodiment, a combination or group of the lower-side manifold plate 22, the damper film 23, the connection channel unit 24, and the upper-side manifold unit 25 corresponds to a second channel member of the present disclosure.

Figure 5:
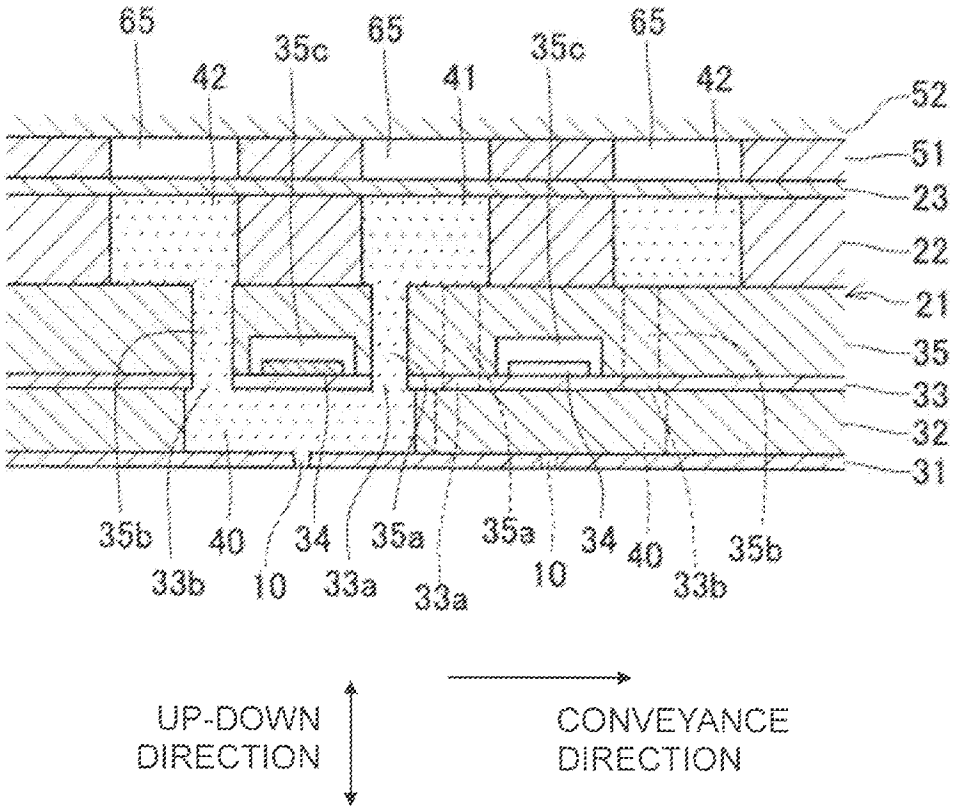
FIG. 5 is a cross-sectional view taken along a line V-V in FIG. 4B.

As depicted in FIGS. 3 to 5, the individual unit 21 includes a nozzle plate 31, a channel substrate 32, a vibration film 33, driving elements 34, and a protection substrate 35. The nozzle plate 31 is made using, for example, a synthetic resin material. The nozzle plate 31 includes nozzles 10 forming the eight nozzle rows 9.

The channel substrate 32, which is made using silicon (Si), is disposed on an upper surface of the nozzle plate 31. The channel substrate 32 includes pressure chambers 40 corresponding to the nozzles 10, respectively. A center portion in the conveyance direction of each of the pressure chambers 40 overlaps in the up-down direction with the corresponding one of nozzles 10. The channel substrate 32 includes eight pressure chamber rows 8 formed by aligning pressure chambers 40 in the width direction. The eight pressure chamber rows 8 are arranged in the conveyance direction.

The vibration film 33, which is provided at an upper end of the channel substrate 32, covers the pressure chambers 40. The vibration film 33 is made using silicon dioxide (SiO2) or silicon nitride (SiN). The vibration film 33 is formed by oxidizing or nitriding the upper end of the channel substrate 32.

The vibration film 33 has inflow holes 33*a* at portions that overlap in the up-down direction with downstream ends in the conveyance direction of the pressure chambers 40 forming the odd-numbered pressure chamber rows 8. Similarly, the vibration film 33 has inflow holes 33*a* at portions that overlap in the up-down direction with upstream ends in the conveyance direction of the pressure chambers 40 forming the even-numbered pressure chamber rows 8. Further, the vibration film 33 has outflow holes 33*b* at portions that overlap in the up-down direction with upstream ends in the conveyance direction of the pressure chambers 40 forming the odd-numbered pressure chamber rows 8. Similarly, the vibration film 33 has outflow holes 33*b* at portions that overlap in the up-down direction with downstream ends in the conveyance direction of the pressure chambers 40 forming the even-numbered pressure chamber rows 8.

The driving elements 34 are provided corresponding to the pressure chambers 40, respectively. The driving elements 34 are arranged on an upper surface of the vibration film 33 at portions that overlap in the up-down direction with the pressure chambers 40. The driving elements 34 are piezoelectric elements including, for example, piezoelectric bodies and electrodes. The configuration of the driving elements 34 is similar to that of conventional driving elements, and thus detailed explanation thereof is omitted here.

The protection substrate 35, which is made using silicon (Si), is disposed on an upper surface of the channel substrate 32 provided with the vibration film 33 and the driving elements 34. The protection substrate 35 includes, at portions that overlap in the up-down direction with the inflow holes 33*a*, supply throttle channels 35*a* that pass through the protection substrate 35 in the up-down direction. Further, the protection substrate 35 includes, at portions that overlap in the up-down direction with the outflow holes 33*b*, return throttle channels 35*b* that pass through the protection substrate 35 in the up-down direction. Further, recesses 35*c* are formed at portions of lower part of the protection substrate 35 that overlap in the up-down direction with the pressure chambers 40 forming each pressure chamber row 8. The driving elements 34 corresponding to each pressure chamber row 8 are accommodated in the recesses 35*c*.

In this embodiment, a channel formed by the pressure chamber 40, the supply throttle channel 35*a*, and the return throttle channel 35*b* corresponds to an individual channel of the present disclosure. A combination or group of the channel substrate 32 including the pressure chamber 40 and the protection substrate 35 including the throttle channels 35*a* and 35*b* corresponds to an individual channel member of the present disclosure.

As depicted in FIGS. 3 to 5, the lower-side manifold plate 22 is disposed on an upper surface of the protection substrate 35. The lower-side manifold plate 22 includes four lower-side supply manifolds 41 (a first supply common channel of the present disclosure) and eight lower-side return manifolds 42 (a first return common channel of the present disclosure). In this embodiment, the lower-side supply manifolds 41 and the lower-side return manifolds 42 correspond to a first common channel of the present disclosure.

Each lower-side supply manifold 41 extend in the width direction along the supply throttle channels 35*a* that correspond to two pressure chamber rows 8 through which an ink in the same color flows. Each lower-side return manifold 42 extends in the width direction along the return throttle channels 35*b* that correspond to each pressure chamber row 8. The lower-side return manifolds 42 are connected to the return throttle channels 35*b*. The lower-side return manifolds 42 extend beyond the lower-side supply manifolds 41 in the width direction.

As depicted in FIGS. 3 and 5, the dumber film 23 is disposed on an upper surface of the lower-side manifold plate 22 to cover the four lower-side supply manifolds 41 and the eight lower-side return manifolds 42. The damper film 23 defines the lower-side supply manifolds 41 and the lower-side return manifolds 42. An elastic deformation of the damper film 23 inhibits the pressure change in the inks in the manifolds 41 and 42.

<Connection Channel Unit>

As depicted in FIGS. 3, 5, and 6, the connection channel unit 24 is configured by four rectangular channel plates 51 to 54 that are stacked on top of each other in the up-down direction. The four channel plates 51 to 54 are long in the width direction. The channel plates 51 to 54 are made, for example, using 42 alloy or stainless steel.

Figure 6A:
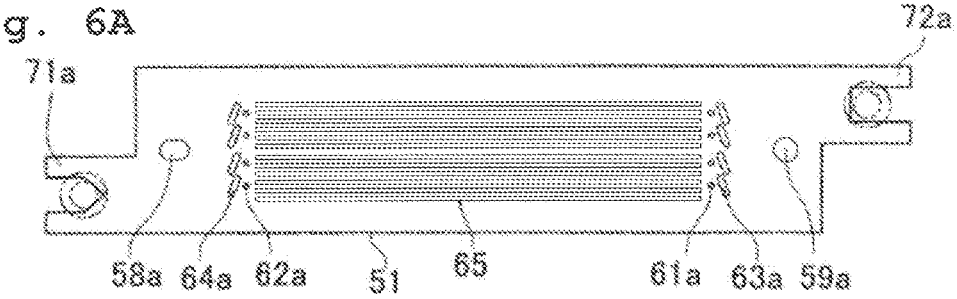
FIG. 6A is a plan view of the lowermost channel plate of a connection channel unit.

The channel plate 51 is disposed on an upper surface of the damper film 23. As depicted in FIG. 6A, the channel plate 51 has four supply channel holes 61*a*, four supply channel holes 62*a*, four return channel holes 63*a*, and four return channel holes 64*a*. The supply channel holes 61*a*, 62*a* and the return channel holes 63*a*, 64*a* are through holes that pass through the channel plate 51 in the up-down direction.

The four supply channel holes 61*a* correspond to the four lower-side supply manifolds 41. Each supply channel hole 61*a* overlaps in the up-down direction with a right end in the width direction of the corresponding one of the lower-side supply manifolds 41. The four supply channel holes 62*a* correspond to the four lower-side supply manifolds 41. Each supply channel hole 62*a* overlaps in the up-down direction with a left end in the width direction of the corresponding one of the lower-side supply manifolds 41.

Each of the four return channel holes 63*a* corresponds to two lower-side return manifolds 42 that are included in the eight lower-side return manifolds 42 and through which an ink in the same color flows. Each return channel hole 63*a* extends across right ends in the width direction of the two lower-side return manifold channels 42 corresponding thereto. Each return channel hole 63*a* is connected to the two lower-side return manifold channels 42.

Each of the four return channel holes 64*a* corresponds to two lower-side return manifolds 42 that are included in the eight lower-side return manifolds 42 and through which an ink in the same color flows. Each return channel hole 64*a* extends across left ends in the width direction of the two lower-side return manifold channels 42 corresponding thereto. Each return channel hole 64*a* is connected to the two lower-side return manifold channels 42.

The channel plate 51 includes, in a portion overlapping in the up-down direction with the lower-side supply manifolds 41 and the lower-side return manifolds 42, a damper chamber 65 extending in the width direction. The damper chamber 65 is a space for receiving an upward deformation of the damper film 23. The damper chamber 65 is formed by a through hole passing through the channel plate 51. Or, the damper chamber 65 may be formed by a recess that is open in a lower surface of the channel plate 51.

The channel plate 51 has a circular positioning hole 59*a* on the right of the supply channel holes 61*a* and the return channel holes 63*a* in the width direction. Further, the channel plate 51 has an oval positioning hole 58*a* on the left of the supply channel holes 62*a* and the return channel holes 64*a* in the width direction. The positioning hole 58*a* is long in the width direction.

Figure 6B:
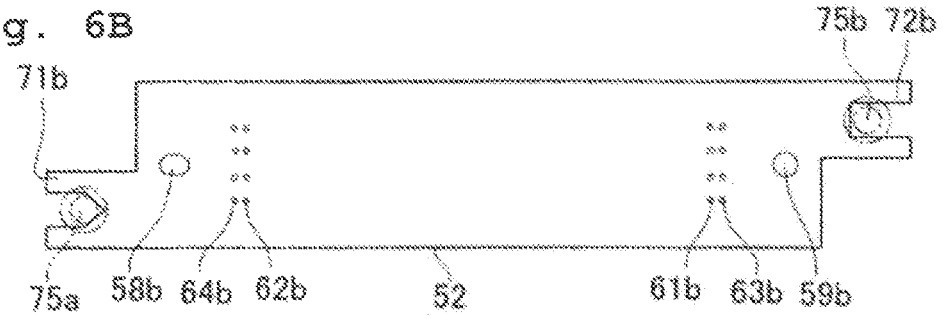
FIG. 6B is a plan view of the second lowermost channel plate of the connection channel unit.

The channel plate 52 is disposed on an upper surface of the channel plate 51. As depicted in FIG. 6B, the channel plate 52 has four supply channel holes 61*b*, four supply channel holes 62*b*, four return channel holes 63*b*, and four return channel holes 64*b*. The supply channel holes 61*b*, 62*b* and the return channel holes 63*b*, 64*b* are through holes that pass through the channel plate 52 in the up-down direction.

The four supply channel holes 61*b* correspond to the four supply channel holes 61*a*. Each of the supply channel holes 61*b* overlaps in the up-down direction with the corresponding one of the supply channel holes 61*a*. The four supply channel holes 62*b* correspond to the four supply channel holes 62*a*. Each of the supply channel holes 62*b* overlaps in the up-down direction with the corresponding one of the supply channel holes 62*a*. The four return channel holes 63*b* correspond to the four return channel holes 63*a*. Each of the return channel holes 63*b* overlaps in the up-down direction with a center portion of the corresponding one of the return channel holes 63*a*. The four return channel holes 64*b* correspond to the four return channel holes 64*a*. Each of the return channel holes 64*b* overlaps in the up-down direction with a center portion of the corresponding one of the return channel holes 64*a*.

Figure 6C:
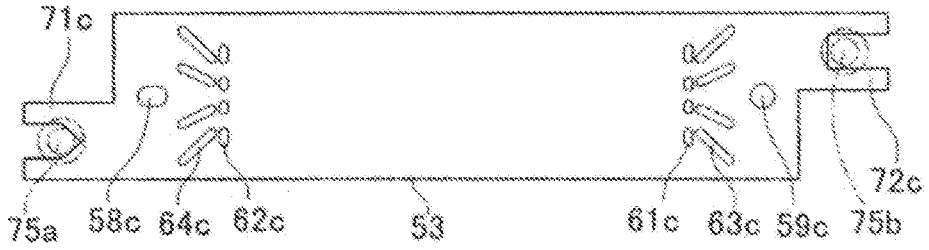
FIG. 6C is a plan view of the second uppermost channel plate of the connection channel unit.

The channel plate 53 is disposed on an upper surface of the channel plate 52. As depicted in FIG. 6C, the channel plate 53 has four supply channel holes 61*c*, four supply channel holes 62*c*, four return channel holes 63*c*, and four return channel holes 64*c*. The supply channel holes 61*c*, 62*c* and the return channel holes 63*c*, 64*c* are through holes that pass through the channel plate 53 in the up-down direction.

The four supply channel holes 61*c* correspond to the four supply channel holes 61*b*. Each of the supply channel holes 61*c* overlaps in the up-down direction with the corresponding one of the supply channel holes 61*b*. The first and second supply channel holes 61*c* extend from portions overlapping in the up-down direction with the supply channel holes 61*b* toward the upstream side in the conveyance direction. The third and fourth supply channel holes 61*c* extend from portions overlapping in the up-down direction with the supply channel holes 61*b* toward the downstream side in the conveyance direction.

The four supply channel holes 62*c* correspond to the four supply channel holes 62*b*. Each of the supply channel holes 62*c* overlaps in the up-down direction with the corresponding one of the supply channel holes 62*b*. The first and second supply channel holes 62*c* extend from portions overlapping in the up-down direction with the supply channel holes 62*b* toward the upstream side in the conveyance direction. The third and fourth supply channel holes 62*c* extend from portions overlapping in the up-down direction with the supply channel holes 62*b* toward the downstream side in the conveyance direction.

The four return channel holes 63*c* correspond to the four return channel holes 63*b*. Each of the return channel holes 63*c* overlaps in the up-down direction with the corresponding one of the return channel holes 63*b*. The first and second return channel holes 63*c* extend rightward from portions overlapping in the up-down direction with the return channel holes 63*b* such that inclination of the first and second return channel holes 63*c* to the width direction is greater toward the upstream side in the conveyance direction. The third and fourth return channel holes 63*c* extend rightward from portions overlapping in the up-down direction with the return channel holes 63*b* such that inclination of the third and fourth return channel holes 63*c* to the width direction is greater toward the downstream side in the conveyance direction.

The four return channel holes 64*c* correspond to the four return channel holes 64*b*. Each of the return channel holes 64*c* overlaps in the up-down direction with the corresponding one of the return channel holes 64*b*. The first and second return channel holes 64*c* extend leftward from portions overlapping in the up-down direction with the return channel holes 64*b* such that inclination of the first and second return channel holes 64*c* to the width direction is greater toward the upstream side in the conveyance direction. The third and fourth return channel holes 64*c* extend leftward from portions overlapping in the up-down direction with the return channel holes 64*b* such that inclination of the third and fourth return channel holes 64*c* to the width direction is greater toward the downstream side in the conveyance direction.

Figure 6D:
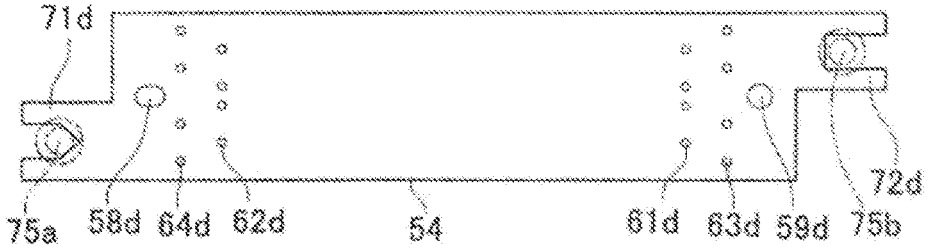
FIG. 6D is a plan view of the uppermost channel plate of the connection channel unit.
Figure 6D:
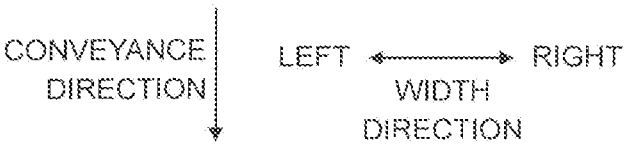

The channel plate 54 is disposed on an upper surface of the channel plate 53. As depicted in FIG. 6D, the channel plate 54 has four supply channel holes 61*d*, four supply channel holes 62*d*, four return channel holes 63*d*, and four return channel holes 64*d*. The supply channel holes 61*d* and 62*d* and the return channel holes 63*d* and 64*d* are through holes that pass through the channel plate 54 in the up-down direction.

The four supply channel holes 61*d* correspond to the four supply channel holes 61*c*. Each of the supply channel holes 61*d* overlaps in the up-down direction with an end of the corresponding one of the supply channel holes 61*c* that is opposite to the portion overlapping in the up-down direction with the supply channel hole 61*b*. The four supply channel holes 62*d* correspond to the four supply channel holes 62*c*. Each of the supply channel holes 62*d* overlaps in the up-down direction with an end of the corresponding one of the supply channel holes 62*c* that is opposite to the portion overlapping in the up-down direction with the supply channel hole 62*b*.

The four return channel holes 63*d* correspond to the four return channel holes 63*c*. Each of the return channel holes 63*d* overlaps in the up-down direction with an end of the corresponding one of the return channel holes 63*c* that is opposite to the portion overlapping in the up-down direction with the return channel hole 63*b*. The four return channel holes 64*d* correspond to the four return channel holes 64*c*. Each of the return channel holes 64*d* overlaps in the up-down direction with an end of the corresponding one of the return channel holes 64*c* that is opposite to the portion overlapping in the up-down direction with the return channel hole 64*b*.

As depicted in FIGS. 6B to 6D, the channel plates 52 to 54 respectively have circular positioning holes 59*b* to 59*d* at portions overlapping in the up-down direction with the positioning hole 59*a*. The channel plates 52 to 54 respectively have oval positioning holes 58*b* to 58*d* at portions overlapping in the up-down direction with the positioning hole 58*a*.

<First and Second Protrusions>

Figure 7:
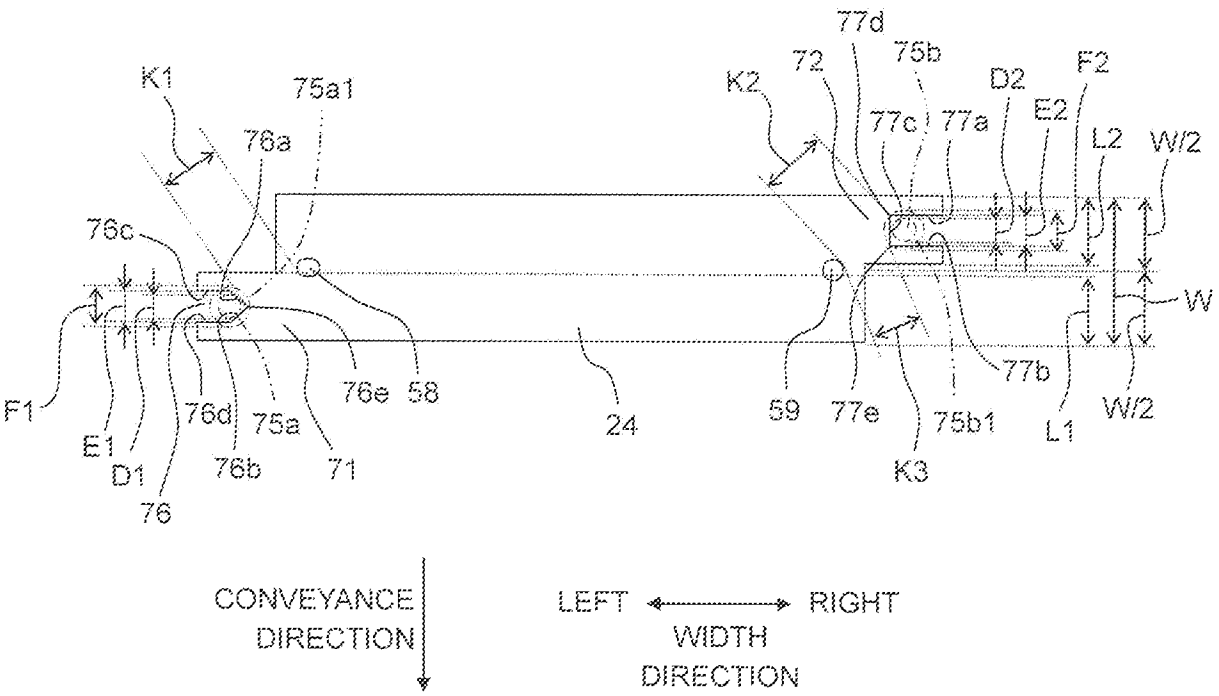
FIG. 7 illustrates relationships between lengths of portions of the connection channel unit.

As depicted in FIGS. 6 and 7, the connection channel unit 24 includes a first protrusion 71 and a second protrusion 72. The first protrusion 71 protrudes leftward in the width direction from a portion included in a left end in the width direction of the connection channel unit 24 and positioned on the downstream side in the conveyance direction. The first protrusion 71 is formed by overlapping protrusions 71*a* to 71*d* in the up-down direction. The protrusions 71*a* to 71*d* protrude leftward from left ends in the width direction of the channel plates 51 to 54. The length in the up-down direction of the first protrusion 71 is substantially the same as the length in the up-down direction of the connection channel unit 24. A Length L1 in the conveyance direction of the first protrusion 71 is shorter than half (W/2) of a length W in the conveyance direction of the connection channel unit 24.

The first protrusion 71 includes a notch 76. The notch 76 is open on the left side in the width direction. The notch 76 has first to fourth surfaces 76*a* to 76*d*. The first surface 76*a* is inclined to the width direction and the conveyance direction such that the first surface 76*a* extends upstream in the conveyance direction as the first surface 76*a* extends leftward in the width direction. A first end (right end in FIG. 7) of the second surface 76*b* is connected to a first end (right end in FIG. 7) of the first surface 76*a*. The second surface 76*b* is inclined to the width direction and the conveyance direction such that the second surface 76*b* extends downstream in the conveyance direction as the second surface 76*b* extends leftward in the width direction. A distance K1 is a distance between a connection portion 76*e* at which the first surface 76*a* is connected to the second surface 76*b* and a hole (a first positioning hole of the present disclosure, hereinafter referred to as a positioning hole 58) formed by overlapping the positioning holes 58*a* to 58*d* with positioning holes 58*e* to 58*h* described below. The distance K1 is in a range of not less than 6 mm and not more than 10 mm.

The third surface 76*c* is connected to a second end of the first surface 76*a* that is opposite to the first end of the first surface 76*a*. The third surface 76*c* extends approximately parallel to the width direction. The fourth surface 76*d* is connected to a second end of the second surface 76*b* that is opposite to the first end of the second surface 76*b*. The fourth surface 76*d* extends approximately parallel to the width direction. A distance E1 is a distance in the conveyance direction between the third surface 76*c* and the fourth surface 76*d*. The distance E1 is longer than a diameter D1 of a bolt 75*a* and shorter than a diameter F1 of a screw head 75*a*1 of the bolt 75*a*. Specifically, the diameter D1 of the bolt 75*a* is approximately 2 mm, and the distance E1 is in a range of not less than 3 mm and not more than 5 mm. The diameter F1 of the screw head 75*a*1 is determined depending on the diameter D1 of the bolt 75*a* in accordance with Japanese Industrial Standards (JIS) or the like. In FIG. 1 and the like, the screw head 75*a*1 is depicted to have a circular shape for convenience. However, the bolt 75*a* is, for example, a hexagonal bolt in which the shape of the screw head 75*a*1 is a hexagon.

The second protrusion 72 protrudes rightward in the width direction from a portion included in a right end in the width direction of the connection channel unit 24 and positioned on the upstream side in the conveyance direction. The second protrusion 72 is formed by overlapping protrusions 72*a* to 72*d* in the up-down direction. The protrusions 72*a* to 72*d* protrude rightward from right ends in the width direction of the channel plates 51 to 54. The length in the up-down direction of the second protrusion 72 is substantially the same as the length in the up-down direction of the connection channel unit 24. A Length L2 in the conveyance direction of the second protrusion 72 is shorter than half (W/2) of the length W in the conveyance direction of the connection channel unit 24. Since the length L1 of the first protrusion 71 and the length L2 of the second protrusion 72 are shorter than half (W/2) of the length W of the connection channel unit 24, the first protrusion 71 does not overlap in the width direction with the second protrusion 72.

The second protrusion 72 includes a notch 77. The notch 77 is open on the right side in the width direction. The notch 77 has fifth to seventh surfaces 77*a* to 77*c*. The fifth surface 77*a* is parallel to the width direction. The sixth surface 77*b* is parallel to the sheet with direction. The sixth surface 77*b* is positioned downstream of the fifth surface 77*a* in the conveyance direction and faces the fifth surface 77*a*. A distance E2 is a distance in the conveyance direction between the fifth surface 77*a* and the sixth surface 77*b*. The distance E2 is longer than a diameter D2 of a bolt 75*b* and shorter than a diameter F2 of a screw head 75*b*1 of the bolt 75*b*. For example, the diameter D2 of the bolt 75*b* is approximately 2 mm, and the distance E2 is in a range of not less than 3 mm and not more than 5 mm. The diameter F2 of the screw head 75*b*1 is determined depending on the diameter D2 of the bolt 75*b* in accordance with Japanese Industrial Standards (JIS) or the like. In FIG. 1 and the like, the screw head 75*b*1 is depicted to have a circular shape for convenience. However, the bolt 75*b* is, for example, a hexagonal bolt in which the shape of the screw head 75*b*1 is a hexagon.

The seventh surface 77*c* is parallel to the conveyance direction. The seventh surface 77*c* connects a left end in the width direction of the fifth surface 77*a* and a left end in the width direction of the sixth surface 77*b*. A distance K2 is a distance between a connection portion 77*d* at which the fifth surface 77*a* is connected to the seventh surface 77*c* and a hole (the first positioning hole of the present disclosure, hereinafter referred to as a positioning hole 59) formed by overlapping the positioning holes 59*a* to 59*d* with positioning holes 59*e* to 59*h* described below. The distance K2 is in a range of not less than 6 mm and not more than 10 mm. A distance K3 is a distance between a connection portion 77*e* at which the sixth surface 77*b* is connected to the seventh surface 77*c* and the positioning hole 59. The distance K3 is in a range of not less than 6 mm and not more than 10 mm.

<Positioning of Head Unit 11 and Holding Member 12>

As depicted in FIGS. 1 and 2, two head units 11 that are arranged in the ink-jet head 2 to be adjacent to each other in the width direction are arranged such that positions in the conveyance direction of the nozzle rows 9 of one of the two head units 11 are identical to those of the other, and that the first protrusion 71 of the right-side head unit 11 overlaps in the conveyance direction with the second protrusion 72 of the left-side head unit 11. The first protrusion 71 and the second protrusion 72 of the head unit 11 are secured to the holding member 12 by use of two bolts 75*a* and 75*b* (first and second positioning portions in a cylindrical shape of the present disclosure).

The head unit 11 is disposed so that the bolt 75*a* is positioned in the notch 76 of the first protrusion 71 and the bolt 75*b* is positioned in the notch 77 of the second protrusion 72. Further, the positioning of the head unit 11 is performed so that an outer circumferential surface of the bolt 75*a* makes contact with the first surface 76*a* and the second surface 76*b* of the first protrusion 71. This enables the head unit 11 to be positioned with respect to the bolt 75*a* that protrudes upward from an upper surface of the holding member 12. Further, the distance E2 in the conveyance direction between the fifth surface 76*e* and the sixth surface 77*f* is longer than the diameter D2 of the bolt 75*b*. In that configuration, when the head unit 11 rotates around the bolt 75*a* that functions as a shaft in the state where the positioning of the head unit 11 with respect to the bolt 75*a* is performed, it is possible to adjust the position in a rotation direction within a plane orthogonal to the up-down direction of the head unit 11.

<Upper-Side Manifold Unit>

The upper-side manifold unit 25 is disposed on an upper surface of the connection channel unit 24. As depicted in FIGS. 3 and 8, the upper-side manifold unit 25 includes a filter plate 82 and three channel plates 81, 83, and 84. The filter plate 82 and the channel plates 81, 83, and 84 are rectangular plates that are long in the width direction.

Figure 8A:
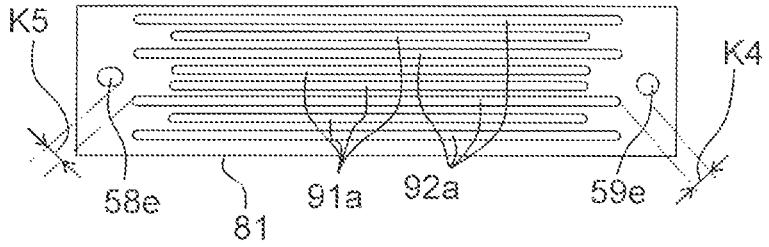
FIG. 8A is a plan view of the lowermost channel plate of an upper-side manifold unit.

As depicted in FIG. 8A, the channel plate 81 includes four supply manifold portions 91*a* and four return manifold portions 92*a*. The four supply manifold portions 91*a*, which extend in the width direction, are arranged in the conveyance direction at intervals. The four return manifold portions 92*a*, which extend in the width direction, are arranged in the conveyance direction at intervals. Each of the supply manifold portions 91*a* is arranged adjacently to the corresponding one of the return manifold portions 92*a* in the conveyance direction. More specifically, the first and second return manifold portions 92*a* are adjacent respectively to upstream portions in the conveyance direction of the first and second supply manifold portions 91*a*. The third and fourth return manifold portions 92*a* are adjacent respectively to downstream portions in the conveyance direction of the third and fourth supply manifold portions 91*a*.

Ends in the width direction of each supply manifold portion 91*a* overlap respectively with the supply channel holes 61*d* and 62*d* in the channel plate 54 of the connection channel unit 24. Ends in the width direction of each return manifold portion 92*a* overlap respectively with the return channel holes 63*d* and 64*d* in the channel plate 54 of the connection channel unit 24.

Figure 8B:
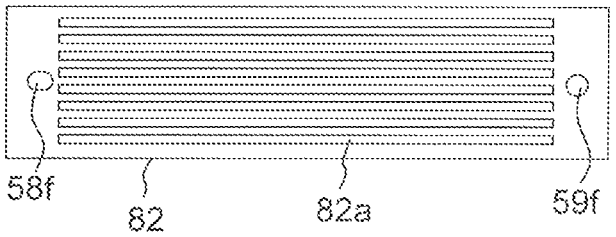
FIG. 8B is a plan view of a filter plate.

The filter plate 82 is disposed on an upper surface of the channel plate 81. As depicted in FIG. 8B, filters 82*a* are formed in the filter plate 82 at portions overlapping in the up-down direction with the supply manifolds 91*a* and at portions overlapping in the up-down direction with the return manifold portions 92*a*.

Figure 8C:
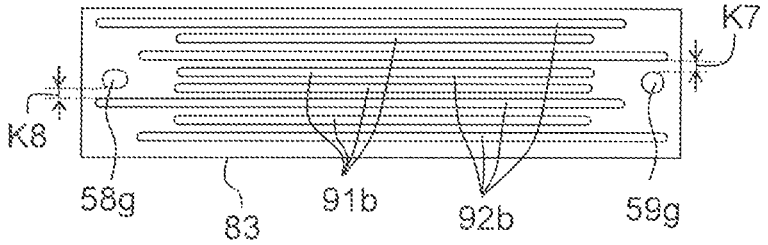
FIG. 8C is a plan view of the second uppermost channel plate of the upper-side manifold unit.

The channel plate 83 is disposed on an upper surface of the filter plate 82. As depicted in FIG. 8C, the channel plate 83 includes four supply manifold portions 91*b* and four return manifold portions 92*b*. The four supply manifold portions 91*b*, which extend in the width direction, overlap in the up-down direction with the four supply manifold portions 91*a*. The four return manifold portions 92*b*, which extend in the width direction, overlap in the up-down direction with the four return manifold portions 92*a*.

The first and third return manifold portions 92*b* extend leftward in the width direction beyond the first and third return manifold portions 92*a*. The second and fourth return manifold portions 92*b* extend rightward in the width direction beyond the second and fourth return manifold portions 92*a*. In that configuration, the positions of the ends in the width direction of the supply manifold portions 91*b* are different from the positions of the ends in the width direction of the return manifold portions 92*b*.

Figure 8D:
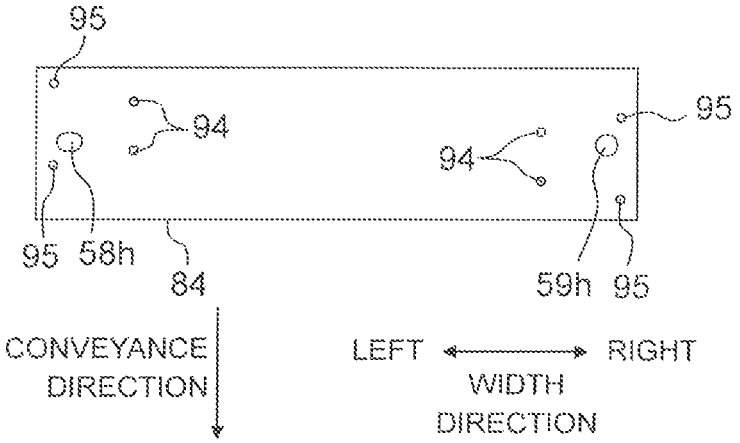
FIG. 8D is a plan view of the uppermost channel plate of the upper-side manifold unit.

The channel plate 84 is disposed on an upper surface of the channel plate 83. As depicted in FIG. 8D, the channel plate 84 has four supply holes 94 and four return holes 95. The four supply holes 94 correspond to the four supply manifold portions 91*b*. The supply holes 94 overlap in the up-down direction with left ends in the width direction of the first and third supply manifold portions 91*b* and right ends in the width direction of the second and fourth supply manifold portions 91*b*.

The four return holes 95 correspond to the four return manifold portions 92*b*. The return holes 95 overlap in the up-down direction with left ends in the width direction of the first and third return manifold portions 92*b* and right ends in the width direction of the second and fourth return manifold portions 92*b*.

As described above, since the positions of the ends in the width direction of the supply manifold portions 91*b* are different from the positions of the ends in the width direction of the return manifold portions 92*b*, the positions in the width direction of the supply holes 94 are different from the positions in the width direction of the return holes 95.

As depicted in FIGS. 8A to 8D, the channel plates 81 to 84 respectively have circular positioning holes 59*e* to 59*h* at portions overlapping in the up-down direction with the positioning holes 59*a* to 59*d*. The channel plates 81 to 84 respectively have oval positioning holes 59*e* to 59*h* at portions overlapping in the up-down direction with the positioning holes 58*a* to 58*d*.

In the upper-side manifold unit 25, the supply manifold portions 91*a* overlap in the up-down direction with the supply manifold portions 91*b* to form a manifold (hereinafter, referred to as an upper-side supply manifold 91). Further, the return manifold portions 92*a* overlap in the up-down direction with the return manifold portions 92*b* to form a manifold (hereinafter, referred to as an upper-side supply manifold 92). The filters 82*a* divide the upper-side supply manifold 91 into upper and lower portions. The filters 82*a* divide the upper-side return manifold 92 into upper and lower portions.

In this embodiment, the upper-side supply manifold 91 corresponds to a second supply common channel of the present disclosure, the upper-side return manifold 92 corresponds to a second return common channel of the present disclosure, and a combination or group of the upper-side supply manifold 91 and the upper-side return manifold 92 corresponds to a second common channel of the present disclosure.

A distance between the positioning hole 59 and a manifold that is included in the four upper-side supply manifolds 91 and the four upper-side return manifolds 92 and is nearest to the positioning hole 59 (hereinafter, referred to as the shortest distance between the positioning hole 59 and the upper-side manifold) is in a range of not less than 6 mm and not more than 10 mm. More specifically, the shortest distance that is a distance K4 or a distance K6 is in a range of not less than 6 mm and not more than 10 mm. The distance K4 is a distance between the positioning hole 59*e* and a manifold portion that is included in the four supply manifold portions 91*a* and the four return manifold portions 92*a* and is nearest to the positioning hole 59*e*. The distance K6 is a distance between the positioning hole 59*g* and a manifold portion that is included in the four supply manifold portions 91*b* and the four return manifold portions 92*b* and is nearest to the positioning hole 59*g*.

A distance between the positioning hole 58 and a manifold that is included in the four upper-side supply manifolds 91 and the four upper-side return manifolds 92 and is nearest to the positioning hole 58 (hereinafter, referred to as the shortest distance between the positioning hole 58 and the upper-side manifold) is in a range of not less than 6 mm and not more than 10 mm. More specifically, the shortest distance that is a distance K5 or a distance K7 is in a range of not less than 6 mm and not more than 10 mm. The distance K5 is a distance between the positioning hole 58*e* and a manifold portion that is included in the four supply manifold portions 91*a* and the four return manifold portions 92*a* and is nearest to the positioning hole 58*e*. The distance K7 is a distance between the positioning hole 58*g* and a manifold portion that is included in the four supply manifold portions 91*b* and the four return manifold portions 92*b* and is nearest to the positioning hole 58*g*.

In the head unit 11, a channel (hereinafter referred to as a supply connection channel 61) formed by connecting the supply channel holes 61*a* to 61*d* connects a right end in the width direction of one lower-side supply manifold 41 and a right end in the width direction of one upper-side supply manifold 91. Further, a channel (hereinafter referred to as a supply connection channel 62) formed by connecting the supply channel holes 62*a* to 62*d* connects a left end in the width direction of one lower-side supply manifold 41 and a left end in the width direction of one upper-side supply manifold 91.

In the head unit 11, a channel (hereinafter referred to as a return connection channel 63) formed by connecting the return channel holes 63*a* to 63*d* connects right ends in the width direction of two lower-side return manifolds 42 and a right end in the width direction of one upper-side return manifold 92. Further, a channel (hereinafter referred to as a return connection channel 64) formed by connecting the return channel holes 64*a* to 64*d* connects left ends in the width direction of two lower-side return manifolds 42 and a left end in the width direction of one return manifold 92.

In this embodiment, a portion that is included in the return channel holes 63*a* and 63*b* of the return connection channels 63 and 64 and is connected to the lower-side return manifold 42 corresponds to a first channel portion of the present disclosure. Any other portions than the above correspond to a second channel portion of the present disclosure.

In this embodiment, when the channel plates 51 to 54 forming the connection channel unit 24 are joined to the plates 81 to 84 forming the upper-side manifold unit 25, positioning pins having a cylindrical shape are inserted into the positioning holes 59*a* to 59*h* and the positioning holes 58*a* to 58*h*. Accordingly, the positioning of the plates 51 to 54 and the plates 81 to 84 is performed.

In the head unit 11, a length H3 in the up-down direction of the connection channel unit 24 is longer than a length H1 in the up-down direction of the lower-side manifold plate 22 and a length H2 in the up-down direction of the upper-side manifold unit 25. For example, the length H1 is approximately 0.5 mm, the length H2 is approximately 1.0 mm, and the length H3 is 1.35 mm.

<Tube Connection Member>

Figure 9:
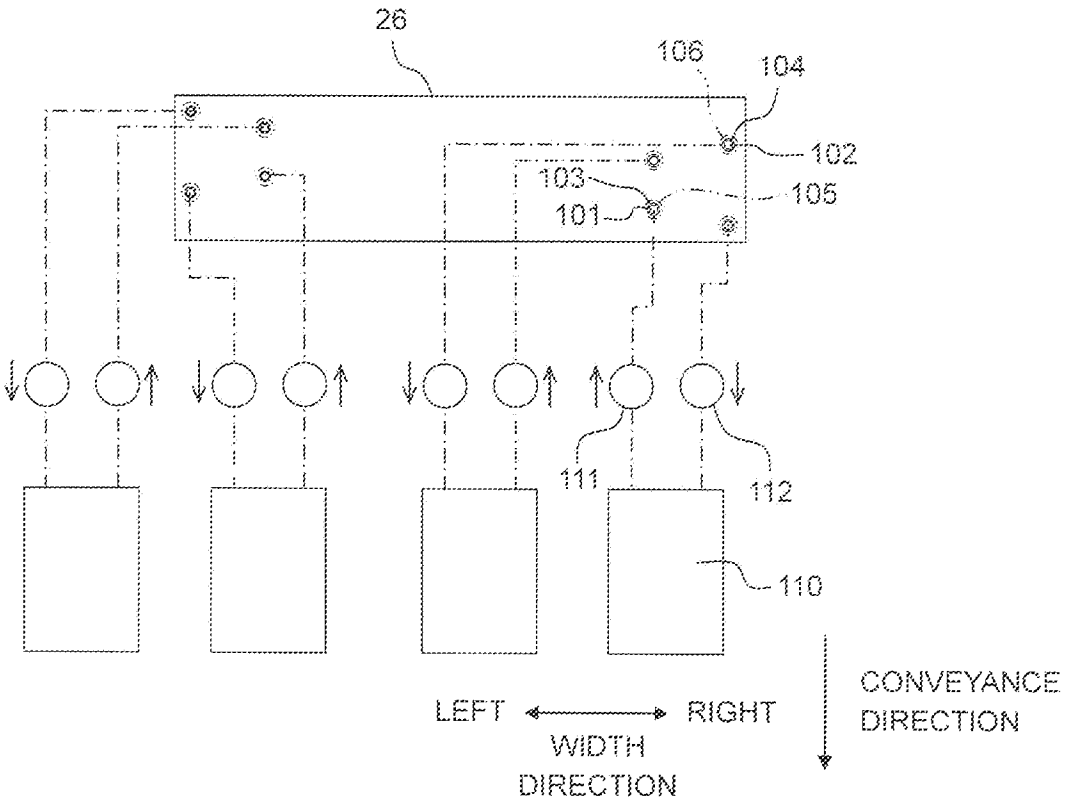
FIG. 9 is a plan view of a tube connection member.

As depicted in FIG. 3, the tube connection member 26, which is a block-like member having a rectangular parallelepiped shape, is made using a synthetic resin material and the like. The tube connection member 26 is disposed on an upper surface of the upper-side manifold unit 25. As depicted in FIG. 9, the tube connection member 26 includes four supply channels 101 and four return channels 102.

The four supply channels 101 correspond to the four supply holes 94 of the channel plate 84 of the upper-side manifold unit 25. Each of the supply channels 101 extends in the up-down direction and is connected to the corresponding one of the supply holes 94. The four return channels 102 correspond to the four return holes 95 of the channel plate 84. Each of the return channels 102 extends in the up-down direction and is connected to the corresponding one of the supply holes 95.

The tube connection member 26 includes four supply tube connection portions 103 and four return tube connection portions 104. The four supply tube connection portions 103 protrude upward (toward the side opposite to the upper-side manifold unit 25) from an upper surface of the tube connection member 26. The four supply tube connection portions 103 correspond to the four supply channels 101. Each of the supply tube connection portions 103 is connected to the corresponding one of the supply channels 101.

Supply tubes 105 are connected to the respective supply tube connection portions 103. Each of the supply tube connection portions 103 is connected to an ink tank 110 storing the corresponding color of ink via the corresponding one of the supply tubes 105. A supply pump 111 is connected to part of the supply tube 105 between the supply tube connection portion 103 and the ink tank 110. The supply pump 111 pumps ink from the ink tank 110 to the supply tube connection portion 103.

The four return tube connection portions 104 protrude upward from the upper surface of the tube connection member 26. The four return tube connection portions 104 correspond to the four return channels 102. Each of the return tube connection portions 104 is connected to the corresponding one of the return channels 102.

The respective return tube connection portions 104 are connected to return tubes 106. Each of the return tube connection portions 104 is connected to an ink tank 110 storing the corresponding color of ink via the corresponding one of the return tubes 106. A return pump 112 is connected to part of the return tube 106 between the return tube connection portion 104 and the ink tank 110. The return pump 112 pumps ink from the return tube connection portion 104 to the ink tank 110.

When the supply pump 111 and the return pump 112 are driven, the ink in the ink tank 110 flows through the supply tube 105, the supply tube connection portion 103, the supply channel 101, the upper-side supply manifold 91, the supply connection channels 61 and 62, the lower-side supply manifold 41, and the supply throttle channel 35*a* in that order, and then flows into the pressure chamber 40 through the inflow hole 33*a*. The ink in the pressure chamber 40 outflows through the outflow hole 33*b*, flows through the return throttle channel 35*b*, the lower-side return manifold 42, the return connection channels 63 and 64, the upper-side return manifold 92, the return channel 102, the return tube connection portion 104, and the return tube 106 in that order, and returns to the ink tank 110. Namely, the ink circulates between the ink tank 110 and each head unit 11.

In this embodiment, a channel formed by the lower-side supply manifold 41, the connection channels 61 and 62, and the upper-side supply manifold 91 corresponds to a supply channel of the present disclosure. A portion of the head unit 11 where those channels are formed corresponds to a supply channel portion of the present disclosure. A channel formed by the lower-side return manifold 42, the connection channels 63 and 64, and the upper-side return manifold 91 corresponds to a return channel of the present disclosure. A portion of the head unit 11 where those channels are formed corresponds to a return channel portion of the present disclosure.

Effect of Embodiment

In this embodiment, the channel substrate 32 is disposed above the nozzle plate 31, the lower-side manifold plate 22 is disposed on the upper surface of the channel substrate 32, the upper-side manifold unit 25 is disposed above the lower-side manifold plate 22, and the connection channel unit 24 is disposed between the lower-side manifold plate 22 and the upper-side manifold unit 25. The connection channel unit 24 includes the first protrusion 71 and the second protrusion 72 that are secured to the holding member 12. In that configuration, securing portions secured to the holding member 12 of the head unit 11 are provided in positions relatively close to the nozzles 10. This makes it possible to reduce the positional shift of the nozzles 10 with respect to the protrusions 71 and 72 as much as possible which may otherwise be caused when the head unit 11 is secured to the holding member 12.

In this embodiment, the length H3 in the up-down direction of the connection channel unit 24 is longer than the length H1 in the up-down direction of the lower-side manifold plate 22 and the length H2 in the up-down direction of the upper-side manifold unit 25. This makes the strength of the connection channel unit 24 high, and the head unit 11 is firmly secured to the holding member 12 by providing the protrusions 71 and 72 in the connection channel unit 24.

In this embodiment, the number of the upper-side return manifolds 92 is smaller than the number of the lower-side return manifolds 42. The connection channel unit 24 includes the connection channels 63 and 64 connecting two lower-side return manifolds 42 and one upper-side return manifold 92. The connection channels 63 and 64 are required to have the first channel portion connected to the lower-side manifolds 42 and the second channel portion connecting two first channel portions and the upper-side return manifold 92. This lengthens the length H3 in the up-down direction of the connection channel unit 24 formed having the connection channels 63 and 64. The head unit 11 is thus firmly secured to the holding member 12 by providing the protrusions 71 and 72 in the connection channel unit 24.

In this embodiment, the damper film 23 is disposed between the lower-side manifold plate 22 and the connection channel unit 24. The damper chamber 65 is formed at a lower end (channel plate 51) of the connection channel unit 24 to receive an upward deformation of the damper film 23. This lengthens the length H3 in the up-down direction of the connection channel unit 24 including the damper chamber 65. The head unit 11 is thus firmly secured to the holding member 12 by providing the protrusions 71 and 72 in the connection channel unit 24.

In this embodiment, the strength of the connection channel unit 24 is enhanced by making the channel plates 51 to 54 forming the connection channel unit 24 by use of 42 alloy or stainless steel.

In this embodiment, the first protrusion 71 does not overlap with the second protrusion 72 in the width direction. Thus, when the head units 11 are arranged in the width direction so that the nozzle rows 9 have the same position in the conveyance direction, the first protrusion 71 can overlap with the second protrusion 72 in the conveyance direction. This results in a sufficient length in the conveyance direction of the first protrusion 71 and the second protrusion 72. Further, the nozzles 10 of the head units 11 adjacent to each other in the width direction can be arranged at small intervals in the width direction, which is the arrangement direction of the nozzles 10. In that configuration, since the protrusions 71 and 72 do not extend beyond the head unit 11 in the conveyance direction, the head units 11*a* and 11*c* are arranged adjacently to the head units 11*b* and 11*d* at a small interval in the conveyance direction.

When the head unit 11 is attached to the holding member 12, the bolt 75*a* is brought into contact with the first surface 76*a* and the second surface 76*b* of the notch 76 of the first protrusion 71, and the bolt 75*b* is disposed between the fifth surface 77*a* and the sixth surface 77*b* of the notch 77 of the second protrusion 72. This enables the positioning between the head unit 11 and the holding member 12 in the width direction and the conveyance direction, and the positioning between the head unit 11 and the holding member 12 in the rotation direction within the plane orthogonal to the up-down direction.

When the head unit 11 is attached to the holding member 12, the bolt 75*a* is guided along the third surface 76*c* and the fourth surface 76*d*. This allows the bolt 75*a* to be guided to a position where the bolt 75*a* makes contact with the first surface 76*a* and the second surface 76*b*.

In the connection channel unit 24 of this embodiment, the distance between the notch 76 and the positioning hole 57 and the distance between the notch 77 and the positioning hole 59 are in a range of not less than 6 mm and not more than 10 mm. In that configuration, the strength of the connection channel unit 24 is successfully provided by arranging the notch 76 sufficiently away from the positioning hole 58 and arranging the notch 77 sufficiently away from the positioning hole 59 while increasing the connection channel unit 24 in size as little as possible.

In this embodiment, the first protrusion 71 is formed by overlapping the four portions 71*a* to 71*d* of all the channel plates 51 to 54 forming the connection channel unit 24 in the up-down direction, and the second protrusion 72 is formed by overlapping the four portions 72*a* to 72*d* of all the channel plates 51 to 54 forming the connection channel unit 24 in the up-down direction. The length in the up-down direction of the first protrusion 71 and the second protrusion 72 is the same as the length in the up-down direction of the connection channel unit 24. This maximizes the strength of the first protrusion 71 and the second protrusion 72.

In this embodiment, when the channel plates 51 to 54 forming the connection channel unit 24 are joined to the plates 81 to 84 forming the upper-side manifold unit 25, positioning pins having a cylindrical shape are inserted into the positioning holes 59*a* to 59*h* and the positioning holes 58*a* to 58*h*. Accordingly, the positioning of the plates 51 to 54 and the plates 81 to 84 is performed. Since the positioning holes 59*a* to 59*h* are circular, the positioning of the plates 51 to 54 and the plates 81 to 84 is accurately performed based on the positions of the positioning holes 59*a* to 59*h*. The positioning holes 58*a* to 58*h* are oval. Thus, even when some dimension errors occur in the plates 51 to 54 and the plates 81 to 84 at the time of manufacture, the positioning of the plates 51 to 54 and the plates 81 to 84 can be performed by inserting the positioning pins into the positioning holes 59*a* to 59*h* and the positioning holes 58*a* to 58*h*.

In this embodiment, the shortest distance between the positioning holes 58, 59 and the upper-side manifold is in a range of not less than 6 mm and not more than 10 mm. In that configuration, the positioning holes 58 and 59 are arranged sufficiently away from the upper-side supply manifold 91 and the upper-side return manifold 92, making it possible to inhibit ink from leaking from the upper-side supply manifold 91 and the upper-side return manifold 92 to the positioning holes 58 and 59. Further, the strength of the upper-side manifold unit 25 is enhanced.

In the tube connection member 26, the supply tube connection portion 103 is required to be arranged separately from the return tube connection portion 104 to some extent in order to inhibit interference between tubes. In this embodiment, the position in the width direction of the supply tube connection portion 103 is different from the position in the width direction of the return tube connection portion 104. Corresponding to that configuration, the supply manifold portions 91*b* extend in the width direction to positions where the supply manifold portions 91*b* overlap in the up-down direction with the supply tube connection portions 103, and the return manifold portions 92*b* extend in the width direction to positions where the return manifold portions 92*b* overlap in the up-down direction with the return tube connection portions 104. Accordingly, each supply tube connection portion 103 is arranged sufficiently away from each return tube connection port 104 without increasing the head unit 11 in size in the conveyance direction.

Modified Embodiments

Although the embodiment of the present disclosure is explained above, the present disclosure is not limited to the above embodiment, and a variety of modifications are possible without departing from the claims.

In the above embodiment, the position in the width direction of the supply tube connection portion 103 is different from the position in the width direction of the return tube connection portion 104. The present disclosure, however, is not limited thereto. The position in the width direction of the supply tube connection portion 103 may be identical to the position in the width direction of the return tube connection portion 104, and the supply tube connection portion 103 may be arranged adjacently to the return tube connection portion 104 in the conveyance direction.

In the above embodiment, the distance between the positioning hole 59 and the manifold that is included in the upper-side supply manifolds 91 and the upper-side return manifolds 92 and is nearest to the positioning hole 59 is in a range of not less than 0.5 mm and not more than 1.0 mm. The present disclosure, however, is not limited thereto. The distance may be less than 0.5 mm, or may exceed 1.0 mm.

In the above embodiment, the shortest distance between the positioning hole 58 and the upper-side manifold is in a range of not less than 0.5 mm and not more than 1.0 mm.

The present disclosure, however, is not limited thereto. The distance may be less than 0.5 mm, or may exceed 1.0 mm.

In the above embodiment, the positioning holes 59*a* to 59*h* are circular, and the positioning holes 58*a* to 58*h* are oval of which longitudinal direction is the width direction. The present disclosure, however, is not limited thereto. For example, the positioning holes 59*a* to 59*h* may be oval of which longitudinal direction is the width direction, and the positioning holes 58*a* to 58*h* may be circular. Or, for example, both the positioning holes 59*a* to 59*h* and the positioning holes 58*a* to 58*h* may be circular.

In the notch 76 of the above embodiment, the distance K1 between the positioning hole 59 and the connection portion 76*e* where the first surface 76*a* is connected to the second surface 76*b* is in a range of not less than 6 mm and not more than 10 mm. The present disclosure, however, is not limited thereto. The distance K1 may be not more than 6 mm, or may exceed 10 mm.

In the above embodiment, the diameter D1 of the bolt 75*a* is approximately 2 mm, and in the notch 76, the distance E1 in the conveyance direction between the third surface 76*c* and the fourth surface 76*d* is in a range of not less than 3 mm and not more than 5 mm, which is longer than the diameter D1 of the bolt 75*a*. The present disclosure, however, is not limited thereto. The distance E1 in the conveyance direction between the third surface 76*c* and the fourth surface 76*d* may be less than 3 mm or may exceed 5 mm, provided that the distance E1 is longer than the diameter D1 of the bolt 75*a* and shorter than the diameter F1 of the screw head 75*a*1.

In the above embodiment, the notch 76 has the first surface 76*a*, the second surface 76*b*, the third surface 76*c*, and the fourth surface 76*d*. The present disclosure, however, is not limited thereto. The notch 76 may not have at least one of the third surface 76*c* and the fourth surface 76*d*.

In notch 77 of the above embodiment, each of the distance K2 between the connection portion 77*d* where the fifth surface 77*a* is connected to the seventh surface 77*c* and the positioning hole 59 and the distance K3 between the connection portion 77*e* where the sixth surface 77*b* is connected to the seventh surface 77*c* and the positioning hole 59 is in a range of not less than 6 mm and not more than 10 mm. The present disclosure, however, is not limited thereto. At least one of the distances K2 and K3 may be not more than 6 mm, or may exceed 10 mm.

In the above embodiment, the diameter D2 of the bolt 75*b* is approximately 2 mm, and in the notch 77, the distance E2 in the conveyance direction between the fifth surface 77*a* and the sixth surface 77*b* is in a range of not less than 3 mm and not more than 5 mm, which is longer than the diameter D2 of the bolt 75*b*. The present disclosure, however, is not limited thereto. For example, the distance E2 in the conveyance direction between the fifth surface 77*a* and the sixth surface 77*b* may be the same as the diameter D2 of the bolt 75*b*. Further, the distance E2 in the conveyance direction between the fifth surface 77*a* and the sixth surface 77*b* may be less than 3 mm or may exceed 5 mm, provided that the distance E2 is not less than the diameter D2 of the bolt 75*b* and less than the diameter F2 of the screw head 75*b*1.

In the above embodiment, the positioning of the head unit 11 with respect to the holding member 12 is performed by using the bolts 75*a* and 75*b* for securing the head unit 11 to the holding member 12. The present disclosure, however, is not limited thereto. For example, the holding member 12 may include a cylindrical protrusion (a first positioning portion of the present disclosure) that is brought into contact with the first surface 76*a* and the second surface 76*b* of the notch 76. Or, the holding member 12 may include a cylindrical protrusion (a second positioning portion of the present disclosure) disposed between the fifth surface 77*a* and the sixth surface 77*b* of the notch 77. In the above cases, the head unit 11 is secured to the holding member 12 using any other member than the cylindrical protrusions.

In the above embodiment, the first protrusion 71 includes the notch 76 and the second protrusion 72 includes the notch 77. The present disclosure, however, is not limited thereto. The first protrusion 71 may have no notch and the second protrusion 72 may have no notch.

In the above embodiment, the first protrusion 71 is formed by overlapping the portions 71*a* to 71*d* of the channel plates 51 to 54 forming the connection channel unit 24 with each other in the up-down direction, and the second protrusion 72 is formed by overlapping the portions 72*a* to 72*d* of the channel plates 51 to 54 forming the connection channel unit 24 with each other in the up-down direction. The present disclosure, however, is not limited thereto. The first protrusion 71 may be formed by some of the portions 71*a* to 71*d*. In that case, the length in the up-down direction of the first protrusion 71 is shorter than the length in the up-down direction of the connection channel unit 24. The second protrusion 72 may be formed by some of the portions 72*a* to 72*d*. In that case, the length in the up-down direction of the second protrusion 72 is shorter than the length in the up-down direction of the connection channel unit 24.

In the above embodiment, the first protrusion 71 protrudes leftward in the width direction from the portion included in the left end in the width direction of the connection channel unit 24 and positioned on the downstream side in the conveyance direction. The second protrusion 72 protrudes rightward in the width direction from the portion included in the right end in the width direction of the connection channel unit 24 and positioned on the upstream side in the conveyance direction. Further, the length in the conveyance direction of the first protrusion 71 and the second protrusion 72 is shorter than half of the length in the conveyance direction of the connection channel unit 24. The present disclosure, however, is not limited thereto.

For example, the length in the conveyance direction of one of the first protrusion 71 and the second protrusion 72 may be half of the length in the conveyance direction of the connection channel unit 24, provided that the total of the length in the conveyance direction of the first protrusion 71 and the length in the conveyance direction of the second protrusion 72 is shorter than the length in the conveyance direction of the connection channel unit 24.

Alternatively, for example, the first protrusion 71 may protrude leftward in the width direction from a portion of the left end in the width direction of the connection channel unit 24, and the second protrusion 72 may protrude rightward in the width direction from a portion that is included in the right end in the width direction of the connection channel unit 24 and does not overlap with the first protrusion 71 in the width direction. In that configuration, the first protrusion 71 may include multiple first protrusions 71 protruding from portions that are included in the left end in the width direction of the connection channel unit 24 and separated from each other in the conveyance direction, and the second protrusion 72 may include multiple second protrusions 72 protruding from portions that are included in the right end in the width direction of the connection channel unit 24 and separated from each other in the conveyance direction.

In the above embodiment, the head units 11, in which multiple nozzles 10 are aligned in the width direction, are aligned in the width direction to form a row of the head units 11. The row of head units 11 includes two rows of the head units 11 arranged in the conveyance direction. The first protrusion 71 and the second protrusion 72 protrude in the width direction from the ends in the width direction of each connection channel unit 24. The present disclosure, however, is not limited thereto. For example, instead of the first protrusion 71 and the second protrusion 72, protrusions protruding in the conveyance direction from ends in the conveyance direction of each connection channel unit 24 may be provided.

The securing portions provided in the connection channel unit 24 and secured to the holding member 12 are not limited to the protrusions protruding from the connection channel unit 24. Each securing portion provided in the connection channel unit 24 may have a shape different from the protrusion protruding from the connection channel unit 24.

In the above embodiment, all the channel plates 51 to 54 forming the connection channel unit 24 are made using 42 alloy or stainless steel. The present disclosure, however, is not limited thereto. For example, only some of the channel plates 51 to 54 may be made using 42 alloy or stainless steel. Even this configuration can provide some degree of strength of the connection channel unit 24. Or, all the channel plates 51 to 54 may be made using a material different from 42 alloy and stainless steel.

In the above embodiment, the damper chamber 65 is provided in the channel plate 51 of the connection channel unit 24 to receive an upward elastic deformation of the damper film 23. The present disclosure, however, is not limited thereto. For example, each head unit 11 may not include the damper film 23, and the channel plate 51 may not include the damper chamber 65.

In the above embodiment, the number of upper-side return manifolds 92 is smaller than the number of lower-side return manifolds 42. The connection channel unit 24 includes the connection channels 63 and 64 connecting two lower-side manifolds 42 and one upper-side return manifold 92. The present disclosure, however, is not limited thereto. For example, the number of upper-side return manifolds 92 may be the same as the number of lower-side return manifolds 42. The connection channel unit 24 may include connection channels each connecting one lower-side return manifold 42 and one upper-side return manifold 92.

In the above embodiment, the length H3 in the up-down direction of the connection channel unit 24 is longer than the length H1 in the up-down direction of the lower-side manifold plate 22 and the length H2 in the up-down direction of the upper-side manifold unit 25. The present disclosure, however, is not limited thereto. The length in the up-down direction of the connection channel unit 24 may be not more than the length in the up-down direction of the upper-side manifold unit 25 or may be not more than the length in the up-down direction of the lower-side manifold plate 22.

In the above examples, the securing portions secured to the holding member 12 are provided only in the connection channel unit 24. The present disclosure, however, is not limited thereto.

Figure 10:
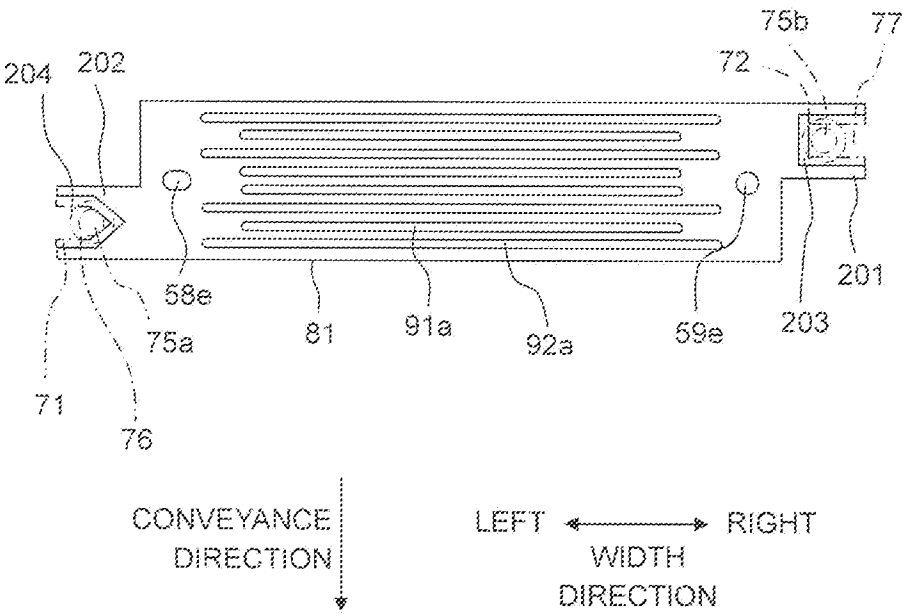
FIG. 10 is a plan view of the lowermost channel plate of the upper-side manifold unit according to a modified embodiment.

In a modified embodiment, as depicted in FIG. 10, a first strengthening portion 201 and a second strengthening portion 202 are provided in the channel plate 81 that is included in the channel plates 81 to 84 forming the upper-side manifold unit 25 and positioned at the lowermost side.

The first strengthening portion 201 protrudes rightward in the width direction from a portion included in a right end in the width direction of the channel plate 81 and positioned at an upstream side in the conveyance direction, and overlaps in the up-down direction with the first protrusion 71. The lengths in the width direction and the conveyance direction of the first strengthening portion 201 are substantially the same as those of the first protrusion 71.

The first strengthening portion 201 includes a notch 203. The notch 203 is larger to some extent than the notch 76 of the first protrusion 71. The notch 203 has four surfaces parallel to the first to fourth surfaces 76*a* to 76*d*. When seen from above, the notch 76 is positioned inside the notch 203. In FIG. 10, the position of the notch 76 of the first protrusion 71 and the position of the notch 77 of the second protrusion 72 are depicted by dashed-dotted line for reference.

The second strengthening portion 202 protrudes leftward in the width direction from a portion included in a left end in the width direction of the channel plate 81 and positioned at a downstream side in the conveyance direction, and overlaps in the up-down direction with the second protrusion 72. The lengths in the width direction and the conveyance direction of the second strengthening portion 202 are substantially the same as those of the second protrusion 72.

The second strengthening portion 202 includes a notch 204. The notch 204 is larger to some extent than the notch 77 of the second protrusion 72. The notch 204 has there surfaces parallel to the fifth to seventh surfaces 77*a* to 77*c*. When seen from above, the notch 77 is positioned inside the notch 204.

In this modified embodiment, the strength of the first protrusion 71 secured to the holding member 12 can be improved by strengthening the first protrusion 71 by use of the first strengthening portion 201. Further, the strength of the second protrusion 72 secured to the holding member 12 can be improved by strengthening the second protrusion 72 by use of the second strengthening portion 202.

In this modified embodiment, the notch 203 of the first strengthening portion 201 is larger than the notch 76 of the first protrusion 71. When seen from above, the notch 76 is positioned inside the notch 203. In that configuration, the first strengthening portion 201 does not interfere with the positioning between the head unit 11 and the holding member 12 that is performed by bringing the bolt 75*a* into contact with the first surface 76*a* and the second surface 76*b* of the notch 76.

In this modified embodiment, the notch 204 of the second strengthening portion 202 is larger than the notch 77 of the second protrusion 72. When seen from above, the notch 77 is positioned inside the notch 204. In that configuration, the second strengthening portion 202 does not interfere with the positioning between the head unit 11 and the holding member 12 that is performed by disposing the bolt 75*b* between the fifth surface 77*a* and the sixth surface 77*b* of the notch 77.

In the above modified embodiment, the first and second strengthening portions 201 and 202 are formed only in the channel plate 81 that is included in the channel plates 81 to 84 forming the upper-side manifold unit 25 and positioned at the lowermost side. The present disclosure, however, is not limited thereto. First and second strengthening portions that are similar to the first and second strengthening portions 201 and 202 may be provided in all the channel plates 81 to 84 forming the upper-side manifold unit 25 or may be provided in some of the channel plates 81 to 84 forming the upper-side manifold unit 25 that are stacked on top of each other at a lower side.

In the above modified embodiment, the first and second strengthening portion 201 and 202 are provided in the upper-side manifold unit 25 positioned above the connection channel unit 24. The present disclosure, however, is not limited thereto. The first and second strengthening portions 201 and 202 may be provided in the lower-side manifold plate 22 positioned below the connection channel unit 24, instead of the upper-side manifold unit 25. Or, the first and second strengthening portions 201 and 202 may be provided both in the upper-side manifold unit 25 and the lower-side manifold plate 22.

In the above modified embodiment, both the first strengthening portion 201 strengthening the first protrusion 71 and the second strengthening portion 202 strengthening the second protrusion 72 are provided. The present disclosure, however, is not limited thereto. One of the first strengthening portion 201 and the second strengthening portion 202 may be provided.

In the above modified embodiment, the notch 203 of the first strengthening portion 201 has the surfaces parallel to the first to fourth surfaces 76*a* to 76*d* of the notch 76. The present disclosure, however, is not limited thereto. The notch 203 of the first strengthening portion 201 may have a shape different from that described above, provided that the notch 203 is larger than the notch 76, and that the notch 76 is positioned inside the notch 203 of the first strengthening portion 201 when seen from the above.

In the above modified embodiment, the notch 204 of the second strengthening portion 202 has the surfaces parallel to the fifth to seventh surfaces 77*a* to 77*a* of the notch 77. The present disclosure, however, is not limited thereto. The notch 204 of the second strengthening portion 202 may have a shape different from that described above, provided that the notch 204 of the second strengthening portion 202 is larger than the notch 77, and that the notch 77 is positioned inside the notch 204 of the second strengthening portion 202 when seen from the above.

The notch 203 of the first strengthening portion 201 may have the same shape and size as those of the notch 76 of the first protrusion 71. The notch 204 of the second strengthening portion 202 may have the same shape and size as those of the notch 77 of the second protrusion 72.

The securing portions secured to the holding member 12, such as the protrusions, may be provided only in a member other than the connection channel unit 24. For example, the securing portions, such as the protrusions, may be provided in only one of the lower-side manifold plate 22 and the upper-side manifold unit 25. In that configuration, the securing portions are provided only in a member, other than the connection channel unit 24, positioned between the nozzle plate 31 and the tube connection member 26.

The ink flowing direction in the above examples may be reversed. Namely, the channel for returning ink from the pressure chamber 40 to the ink tank 110 in the above examples may be used as the channel for supplying ink from the ink tank 110 to the pressure chamber 40. The channel for supplying ink from the ink tank 110 to the pressure chamber 40 in the above examples may be used as the channel for returning ink from the pressure chamber 40 to the ink tank 110.

The above explanations include an example in which the present disclosure is applied to each head unit 11 including, between the nozzle plate 31 and the tube connection member 26, the channel substrate 32, the vibration film 33, the protection substrate 35, the lower-side manifold plate 22, the upper-side manifold unit 25, and the connection channel unit 24. The present disclosure, however, is not limited thereto. The present disclosure is applicable to a head unit having a configuration different from the above, the configuration including a nozzle plate including nozzles, a first channel member including a channel through which liquid is supplied to the nozzles, and a second channel member including at least individual channels connected to the nozzles, wherein the second channel member is disposed between the nozzle plate and the first channel member.

For example, the present disclosure is applicable to a liquid discharge head described in Japanese Patent Application Laid-open No. 2017-202677. In this liquid discharge head, a channel substrate (the second channel member of the present disclosure) is disposed between a nozzle plate and a casing (the first channel member of the present disclosure). In such a liquid discharge head, the channel substrate may include securing portions, such as protrusions.

The present disclosure is applicable to an ink-jet recording apparatus described in Japanese Patent No. 5,962,935. For example, this ink-jet recording apparatus has an upper portion (the first channel member of the present disclosure) of a case member that is formed having an introduction path connected to an introduction tube and a discharge path connected to a recovery path (collecting path) and a lower portion (the second channel member of the present disclosure) of the case member including a manifold. In such an ink-jet recording apparatus, the lower portion of the case member may include securing portions, such as protrusions.

The above explanations include an example in which the present disclosure is applied to the ink-jet head configured to discharge ink from nozzles and the printer including this ink-jet head. The present disclosure, however, is not limited thereto. The present disclosure is applicable to a liquid discharge head configured to discharge any other liquid than ink from nozzles and a liquid discharge apparatus including such a liquid discharge head.

What is claimed is:

1. A liquid discharge apparatus, comprising:
at least one liquid discharge head; and
a holding member holding the liquid discharge head,
wherein the at least one liquid discharge head includes:
a nozzle plate in which a plurality of nozzles are open;
a first channel member stacked on the nozzle plate in a first direction and including a channel through which liquid is supplied to the nozzles, and
a second channel member including at least one plate and arranged between the nozzle plate and the first channel member in the first direction, the second channel member including a plurality of individual channels connected to the nozzles,
wherein the second channel member includes a securing portion secured to the holding member; and
wherein the securing portion is provided at a position, in the second channel member, closer to the nozzle plate than the first channel member.

2. The liquid discharge apparatus according to claim 1, wherein the second channel member includes:
a supply channel portion including a supply channel connected to the individual channels, the liquid being supplied from the first channel member to the individual channels through the supply channel, and
a return channel portion including a return channel connected to the individual channels, and the liquid being returned from the individual channels to the first channel member through the return channel.

3. The liquid discharge apparatus according to claim 1, wherein the second channel member includes:
an individual channel member including the individual channels,
a first common channel member stacked on the individual channel member in the first direction and including at least one first common channel connected to the individual channels, a second common channel member disposed at a side opposite to the individual channel member relative to the first common channel member in the first direction and including at least one second common channel connected to the at least one first common channel, and a connection channel member disposed between the first common channel member and the second common channel member in the first direction and including a connection channel connecting the at least one first common channel and the at least one second common channel, wherein the connection channel member includes the securing portion.

4. The liquid discharge apparatus according to claim 3, wherein the connection channel member is longer in the first direction than the first common channel member and the second common channel member.

5. The liquid discharge apparatus according to claim 4, wherein the at least one first common channel includes a plurality of first common channels and the at least one second common channel includes a plurality of second common channels, the number of the second common channels in the second common channel member is smaller than the number of the first common channels in the first common channel member, the connection channel includes a plurality of first channel portions respectively connected to the first common channels and, a plurality of second channel portions connecting one of the second common channels and two or more of the first channel portions.

6. The liquid discharge apparatus according to claim 4, further comprising a damper film disposed between the first common channel and the individual channel member in the first direction and defining the first common channel, wherein the connection channel member includes a damper chamber disposed on a side opposite to the first common channel relative to the damper film in the first direction.

7. The liquid discharge apparatus according to claim 3, wherein the connection channel member includes a plate made of 42 alloy or stainless steel.

8. The liquid discharge apparatus according to claim 3, wherein the at least one liquid discharge head includes a plurality of liquid discharge heads arranged in a second direction intersecting with the first direction, the securing portion includes:

a first protrusion provided at an end positioned on a first side in the second direction of the connection channel member and protruding in the second direction from the connection channel member, and a second protrusion provided at an end positioned on a second side in the second direction of the connection channel member and protruding in the second direction from the connection channel member, the first protrusion does not overlap in the second direction with the second protrusion, and the second protrusion of one of the liquid discharge heads and the first protrusion of another one of the liquid discharge heads overlap with each other in a third direction orthogonal to the first direction and the second direction, the one of the liquid discharge head being arranged at the first side of the another one of the liquid discharge head in the second direction.

9. The liquid discharge apparatus according to claim 8, wherein, in each of the liquid discharge heads, the nozzles are aligned in the second direction and a plurality rows of the liquid discharge heads aligned in the second direction are arranged in the third direction.

10. The liquid discharge apparatus according to claim 9, wherein the holding member includes a first positioning portion in a cylindrical shape that extends in the first direction and is provided to position each of the liquid discharge heads, a first notch is formed at an end positioned on a first side in the first direction of the first protrusion, the first notch has:

a first surface orthogonal to the first direction and extending while being inclined to the second direction and the third direction, and a second surface connected to an end positioned on the second side in the second direction of the first surface and extending orthogonally to the first direction while being inclined to the second direction, the third direction, and the first surface, the first protrusion is positioned with respect to the holding member by bringing the first positioning portion into contact with the first surface and the second surface.

11. The liquid discharge apparatus according to claim 10, wherein the first notch has:

a third surface connected to an end positioned on the first side in the second direction of the first surface and extending in the second direction, and a fourth surface connected to an end positioned on the first side in the second direction of the second surface and extending in the second direction.

12. The liquid discharge apparatus according to claim 11, wherein a distance in the third direction between the third surface and the fourth surface is in a range of not less than 3 mm and not more than 5 mm.

13. The liquid discharge apparatus according to claim 10, wherein a first positioning hole is provided at the first side in the second direction of the connection channel member to position the connection channel member with respect to the first common channel member and the second common channel member, and a distance between the first positioning hole and a connection portion where the first surface is connected to the second surface is in a range of not less than 6 mm and not more than 10 mm.

14. The liquid discharge apparatus according to claim 10, wherein the holding member includes a second positioning portion in a cylindrical shape that extends in the first direction and is provided to position each of the liquid discharge heads, a second notch is formed at an end positioned on the second side in the second direction of the second protrusion, the second notch has:

a fifth surface extending in the second direction, a sixth surface disposed to face the fifth surface in the third direction and extending in the second direction, and a seventh surface extending in the third direction and connecting an end positioned on the first side in the second direction of the fifth surface and an end positioned on the first side in the second direction of the sixth surface, and the second positioning portion is disposed between the fifth surface and the sixth surface.

15. The liquid discharge apparatus according to claim 14, wherein a distance in the third direction between the fifth surface and the sixth surface is longer than a diameter of the second positioning portion.

16. The liquid discharge apparatus according to claim 15, wherein a distance in the third direction between the fifth surface and the sixth surface is in a range of not less than 3 mm and not more than 5 mm.

17. The liquid discharge apparatus according to claim 14, wherein a second positioning hole is provided at the second side in the second direction of the connection channel member to position the connection channel member with respect to the first common channel member and the second common channel member, and a distance between the second positioning hole and a connection portion where the fifth surface is connected to the sixth surface and a distance between the second positioning hole and a connection portion where the sixth surface is connected to the seventh surface are in a range of not less than 6 mm and not more than 10 mm.

18. The liquid discharge apparatus according to claim 14, wherein a length in the first direction of the second protrusion is not less than a length in the first direction of the connection channel member.

19. The liquid discharge apparatus according to claim 18, further comprising a second strengthening portion provided on at least one of the first common channel member and the second common channel member so that the second strengthening portion is joined to the second protrusion to strength the second protrusion.

20. The liquid discharge apparatus according to claim 19, wherein the second strengthening portion includes a notch, and the second notch is positioned inside the notch of the second strengthening portion as viewed in the first direction.

21. The liquid discharge apparatus according to claim 9, wherein a length in the first direction of the first protrusion is not less than a length in the first direction of the connection channel member.

22. The liquid discharge apparatus according to claim 21, further comprising a first strengthening portion provided on at least one of the first common channel member and the second common channel member so that the first strengthening portion is joined to the first protrusion to strength the first protrusion.

23. The liquid discharge apparatus according to claim 22, wherein the first strengthening portion includes a notch, and the first notch is positioned inside the notch of the first strengthening portion as viewed in the first direction.

24. The liquid discharge apparatus according to claim 3, the connection channel member has two positioning holes provided to position the connection channel member with respect to the first common channel member and the second common channel member, and one of the two positioning holes is circular, and the other is oval.

25. The liquid discharge apparatus according to claim 3, wherein each of the connection channel member and the second common channel member has a positioning hole provided to position the connection channel member and the second common channel member with each other, and a distance between the positioning hole in the second common channel member and the second common channel is in a range of not less than 0.5 mm and not more than 1.0 mm.

26. The liquid discharge apparatus according to claim 3, wherein the at least one first common channel includes a plurality of first common channels, the first common channel member includes, as the first common channels, a first supply common channel through which the liquid flows into the individual channels, and a first return common channel through which the liquid flows out of the individual channels, the at least one second common channel includes a plurality of second common channels, the second common channel member includes, as the second common channels, a second supply common channel extending in a second direction orthogonal to the first direction and connected to the first supply common channel and a second return common channel extending in the second direction, disposed to be adjacent to the second supply common channel in a third direction orthogonal to the first direction and the second direction, and connected to the first return common channel, the first channel member includes:

a supply tube connection portion connected to the second supply common channel, protruding in the first direction toward a side opposite to the second common channel member, and connected to a tube via which the second supply common channel is connected to a liquid tank, and a return tube connection portion connected to the second return common channel, protruding in the first direction toward the side opposite to the second common channel member, and connected to a tube via which the second return common channel is connected to the liquid tank, a position in the second direction of the supply tube connection portion is different from a position in the second direction of the return tube connection portion, the second supply common channel extends in the second direction to a position overlapping in the first direction with the supply tube connection portion, and the second return common channel extends in the second direction to a position overlapping in the first direction with the return tube connection portion.

27. A liquid discharge head, comprising:

a nozzle plate in which a plurality of nozzles is open;

a first channel member stacked on the nozzle plate in a first direction and including a channel, liquid being supplied to the nozzles through the first channel, and a second channel member including at least one plate and arranged between the nozzle plate and the first channel member in the first direction, the second channel member including a plurality of individual channels, wherein the second channel member includes a securing portion secured to the holding member; and wherein the securing portion is provided at a position, in the second channel member, closer to the nozzle plate than the first channel member.

28. A liquid discharge apparatus, comprising:

at least one liquid discharge head; and a holding member holding the liquid discharge head, wherein the at least one liquid discharge head includes:

a nozzle plate in which a plurality of nozzles are open;

a first channel member stacked on the nozzle plate in a first direction and including a channel through which liquid is supplied to the nozzles, and a second channel member including at least one plate and arranged between the nozzle plate and the first channel member in the first direction, the second channel member including a plurality of individual channels connected to the nozzles, wherein the second channel member includes:

an individual channel member including the individual channels;

a first common channel member stacked on the individual channel member in the first direction and including at least one first common channel connected to the individual channels;

a second common channel member disposed at a side opposite to the individual channel member relative to the first common channel member in the first direction and including at least one second common channel connected to the at least one first common channel; and a connection channel member disposed between the first common channel member and the second common channel member in the first direction and including a connection channel connecting the at least one first common channel and the at least one second common channel, wherein the connection channel member includes:

a first protrusion provided at an end positioned on a first side in the second direction of the connection channel member and protruding in the second direction from the connection channel member, a first notch is formed at an end positioned on a first side in the first direction of the first protrusion; and a second protrusion provided at an end positioned on a second side in the second direction of the connection channel member and protruding in the second direction from the connection channel member, a second notch is formed at an end positioned on the second side in the second direction of the second protrusion;

wherein the first protrusion and the second protrusion are contacted with the holding member and provided at a position closer to the nozzle plate than the first channel member.

* * * * *